United States Patent [19]

Wetmore

[11] Patent Number: 4,511,288

[45] Date of Patent: Apr. 16, 1985

[54] MODULAR ISLAND DRILLING SYSTEM

[75] Inventor: Sherman B. Wetmore, Westminster, Calif.

[73] Assignee: Global Marine Inc., Los Angeles, Calif.

[21] Appl. No.: 443,529

[22] Filed: Nov. 22, 1982

Related U.S. Application Data

[63] Continuation-in-part of Ser. No. 325,778, Nov. 30, 1981, Pat. No. 4,422,803.

[51] Int. Cl.[3] ..... E02B 15/02

[52] U.S. Cl. ..... 405/217; 405/203; 405/204

[58] Field of Search ..... 405/204–209, 405/217, 60, 195; 52/235

[56] References Cited

U.S. PATENT DOCUMENTS

| | | | |
|---|---|---|---|
| Re. 30,823 | 12/1981 | Guy et al. | 405/204 |
| 875,699 | 1/1908 | Dumais | 405/207 X |
| 2,308,793 | 1/1943 | Upton . | |
| 2,528,089 | 10/1950 | Siecke et al. | 405/205 |
| 2,746,283 | 5/1956 | Abrams | 72/6 |
| 2,892,314 | 6/1959 | Hornsby et al. | 405/205 X |
| 3,209,544 | 10/1965 | Borrmann | 405/208 |
| 3,289,366 | 12/1966 | Abrams | 52/174 |
| 3,465,996 | 9/1969 | Von Wedel | 52/235 X |
| 3,698,198 | 10/1972 | Phelps | 405/204 |
| 3,708,146 | 1/1973 | Lamberton | 249/1 |
| 3,708,987 | 1/1973 | Roulet et al. | 405/205 X |
| 3,726,950 | 4/1973 | Turzillo | 264/32 |
| 3,754,403 | 8/1973 | Mott et al. . | |
| 3,784,357 | 1/1974 | Muraoka | 405/211 X |
| 3,793,840 | 2/1974 | Mott et al. . | |
| 3,833,035 | 9/1974 | Yee | 114/5 T |
| 3,952,527 | 4/1976 | Vinieratos et al. | 405/217 |
| 3,972,199 | 8/1976 | Hudson et al. | 405/217 |
| 4,002,038 | 1/1977 | Phares et al. | 405/203 X |
| 4,011,826 | 3/1977 | Yee | 114/65 A |
| 4,037,424 | 7/1977 | Anders . | |
| 4,114,388 | 9/1978 | Straub | 405/216 |
| 4,132,043 | 1/1979 | Juba | 52/235 X |
| 4,155,671 | 5/1979 | Vos | 405/203 |
| 4,202,647 | 5/1980 | Lany | 405/203 |
| 4,314,776 | 2/1982 | Palmer et al. | 405/203 X |
| 4,422,804 | 12/1983 | Gerwick, Jr. et al. | 405/210 |
| 4,425,055 | 1/1984 | Tiedemann | 405/204 X |

FOREIGN PATENT DOCUMENTS

| | | | |
|---|---|---|---|
| 2647330 | 8/1977 | Fed. Rep. of Germany | 405/204 |
| 1430084 | 3/1976 | United Kingdom | 405/207 |
| 2058181 | 4/1981 | United Kingdom | 405/217 |

OTHER PUBLICATIONS

"Concrete" Developments from Japan, *Global Marine News*, Apr. 1984, p. 12.

*Primary Examiner*—Dennis L. Taylor

*Attorney, Agent, or Firm*—Christie, Parker & Hale

[57] ABSTRACT

A gravity-type offshore structure, useful as an offshore drilling platform, e.g., is provided for use in ice-covered waters such as offshore of the Alaskan and Canadian North Slope. The structure is composed of a plurality of floatable and controllably ballastable modules, each of which can be fully submerged. The modules are stackable by selective ballasting and deballasting operations in a suitable sequence to define a mobile offshore structure. The structure is assemblable adjacent a site of use and is floatable after assembly to, from and between successive sites of use. At each site of use the assembled structure is ballasted by sea water to be supported by the sea floor and to have sufficient deadweight, in combination with its support by the sea floor, to stand against ice loads urging the structure laterally of the site. Major ones of the modules preferably are constructed of reinforced concrete arranged within the modules in a honeycomb cellular fashion. A reinforced concrete armor belt is removably installed around the structure at its on-site load waterline. The structure is useful in a range of water depths. The armor belt is mountable to the structure at a number of different elevations on the structure to suit differing on-site load waterline locations. Individual modules can be used with other modules of the same or different size in a series of offshore structures individually useful in a characteristic range of water depths.

77 Claims, 38 Drawing Figures

MODULAR ISLAND DRILLING SYSTEM

CROSS-REFERENCE TO RELATED APPLICATIONS

This application is a continuation-in-part of application Ser. No. 06/325,778 filed Nov. 30, 1981, now U.S. Pat. No. 4,422,803.

BACKGROUND OF THE INVENTION

1. Field of the Invention

This invention pertains to structural and procedural aspects of offshore platforms useful in Arctic waters on a year-round basis. More particularly, it pertains to a gravity-type offshore platform structure having modular components readily assemblable in Arctic waters and preferably comprised principally of large floatable and ballastable reinforced concrete elements of honeycomb-type internal construction, which elements are assemblable by novel procedures to provide a range of particular platform structures each suited for particular sites of use within a wide range of water depths.

2. Review of the Prior Art and the Need Presented

The seas, bays and inlets on the margins of the Arctic Ocean, outside the realm of the permanent North Polar icepack, present especially difficult problems to those desiring to explore for and to develop the oil and gas reserves which are suspected and known to exist below these waters. These waters are often very shallow; in many areas 100 foot water depths are found 25 miles offshore. These waters are remote from major centers of industry and commerce. They are covered by sheet ice through November to May and by floe ice in June through August, in a typical year. Temperature variations are extreme.

Offshore drilling and production platforms useful in waters of these depths have been developed for use in less hostile environments. The factors noted above, in combination, mean that existing platform structures either cannot be used at all in the Arctic, or they can be used only for short periods annually when waters are free of ice. Existing platforms, if used, must either be moved into, used, and moved out of the area from remote locations between May and November, or they must be stored during ice periods in protected local harbors which, because natural harbors are virtually nonexistent, must be constructed at great cost. For these reasons, existing offshore platforms of conventional design have not been and are not likely to be used in the Arctic.

In recognition of the special problems posed by the Arctic environment, various innovative approaches to offshore operations have been proposed or implemented. Those approaches proposed include the use of a suitable platform and rig structure in a floating state during Arctic open water periods, use of the same structure on land during periods of ice formation and breakup, and use of the same rig on an ice sheet (without allowance for ice movement) during periods when the ice is of sufficient strength to support the structure; see U.S. Pat. No. 3,664,437. Other proposals seek to adapt platforms designed for warmer waters to Arctic conditions by the use of ice cutters and the like to the pylon of a monopod structure or the legs of a jack-up structure; see, for example, U.S. Pat. Nos. 3,669,052, 3,693,360 and 3,696,624. Still other proposals involve the use of massive moored floating platforms of conical or bell-like shape capable of being heaved buoyantly to break and stand against encroaching ice. Yet another proposal involves a massive unitary fixed platform having a conical or hourglass configuration at and adjacent its waterline for causing encroaching ice to ride up on the structure and so break; see U.S. Pat. No. 3,972,199. Other proposals involve combinations and variations of the described proposals.

To date, none of the proposals reviewed above has been adopted in support of offshore operations in the Arctic. The reasons are varied. In some cases, the proposals are not suited to the shallow waters of interest. In other cases, the costs of construction, placement and operation of the proposed structures are unattractive. In some cases, the proposed structures are not sufficiently adaptable to varying sites of use to warrant the requisite investment.

The innovation which has been adopted to date in support of offshore Arctic operations is the artificial island. Artificial islands are constructed in shallow water from rock, gravel and sand to provide an operations site capable of standing against extreme local environmental forces, notably those due to moving sheets or floe ice. While satisfactory and economically feasible in some circumstances, artificial islands have practical limitations on their utility. They are not movable. They are costly to construct; construction costs rise sharply with increasing water depth. Gravel and rock are not naturally readily available in many areas of interest; ready availability of adequate supplies of these materials directly affects the cost of constructing an artificial island. Proposals to overcome these limitations of artificial islands by the use of man-made year-round ice islands have their own limitations and have not been adopted.

It is thus seen that a need exists for a structural and procedural system which provides an Arctic offshore operations platform, such as an oil or gas drilling or production platform. Such a platform should be versatile, i.e., capable of use directly, or without substantial or costly modification, in waters of various depths. The platform should be readily movable to enable it to be used in different places over its useful life which should be long. The system should be adaptable to varying sea floor soils and soil conditions with minimal dredging or other preparation of the sea floor site. The platform must be capable of use year-round in the face of forces, notably ice-generated forces, tending to move the platform from its site of use. The platform should be capable of being readily and economically fabricated in existing construction facilities remote from the Arctic, and moved effectively and efficiently, without undue hazard, to Arctic waters where it can be readily installed without reliance on costly special equipment or procedures. The materials used in constructing the platform should be readily available, of reasonable cost, and compatible with the hostile Arctic environment. The basic platform structure also should be compatible with a wide range of superstructure arrangements, thus enabling the platform to be used by different owners and operators who have their own preferences for functional equipment sets and layouts, and to be used for differing purposes such as exploration drilling, production drilling, and production from completed production wells, among other purposes. Further, the platform structure and its method of installation must be compatible with and protective of indigenous marine life and related environmental standards which are stringent in the Arctic.

SUMMARY OF THE INVENTION

This invention addresses the need identified above in a manner which meets the diverse practical, economic, functional, and environmental criteria and considerations which have been noted among others relevant. The present invention provides novel structural arrangements and procedural sequences which safely, efficiently, effectively and economically comport with the many competing, and often seemingly unreconcilable, factors pertinent to industrial operations and facilities in the Arctic and other areas of extreme conditions.

Briefly stated, in structural terms, the invention resides in a movable offshore structure of the gravity type. The structure is movable buoyantly to and from a site of use on a sea floor, the site being located in waters in a selected range of water depths. The structure, when installed at the site, extends from a lower end located substantially at the sea floor through and above the water surface to an upper operations end which is adapted to carry a selected operations facility. The structure has substantially flat and substantially vertical walls throughout a portion of its height between its lower end and a location a selected distance above the water surface. In such portion of its height, the structure is comprised of at least one base unit. Each base unit is floatable. The base units are reversibly ballastable with sea water adequately to impart to such portion of the structure sufficient negative buoyancy, in combination with the surface engaged by the lower end of the structure, to maintain the structure at a desired position at the site under environmental forces applied horizontally to the structure.

In the presently preferred embodiment of the invention, each base unit is fabricated of reinforced concrete arranged within the unit to define a plurality of vertical cells and intercell webs.

More preferably, the structural composition of the structure is such that it is comprised of one or more tiers of modular structural units which are structurally interrelated and equipped to cause the structure to have a desired geometry and a desired suitability for an intended purpose consistent with the environment at the site. The modular units include at least one of the base units which has selected height. Means cooperate between the units in each tier and in adjacent tiers for securing the units from lateral relative movement in response to environmental forces. Each unit has a buoyant state. Ballast means are operable for controllably ballasting each unit between its buoyant state and a state of reduced buoyancy which preferably is a state of substantial negative buoyancy. The several units are assemblable into the structure by selective ballasting, deballasting and mating of the units in a predetermined sequence. The several units, when assembled, are floatable as an entity into and out of partially submerged forceful engagement with a sea floor in waters within the selected range of depths.

Organizationally, the offshore structure preferably is provided as a kit of components having interrelated and coordinated features and dimensions. The kit includes a plurality of base units of standardized horizontal dimension but of differing heights, standardized deck storage barges which may or may not carry the desired operations facility as a part of their outfitting, a plurality of armor panels which are mountable to the base units at desired vertical positions on the base units, and, where required, a spread base assembly upon which the pertinent base units can be landed at the site. Suitable accessories are provided for interconnecting the base units in a particular structure.

DESCRIPTION OF THE DRAWINGS

The above-mentioned and other features and characteristics of this invention are more fully set forth in the following detailed description of a presently preferred and other forms of structural and procedural embodiments of the invention. The following description is presented with reference to the accompanying drawings wherein:

FIG. 24 shows the use of soffits in the construction of the base unit;

DESCRIPTION OF THE ILLUSTRATED EMBODIMENTS

Figure 1:
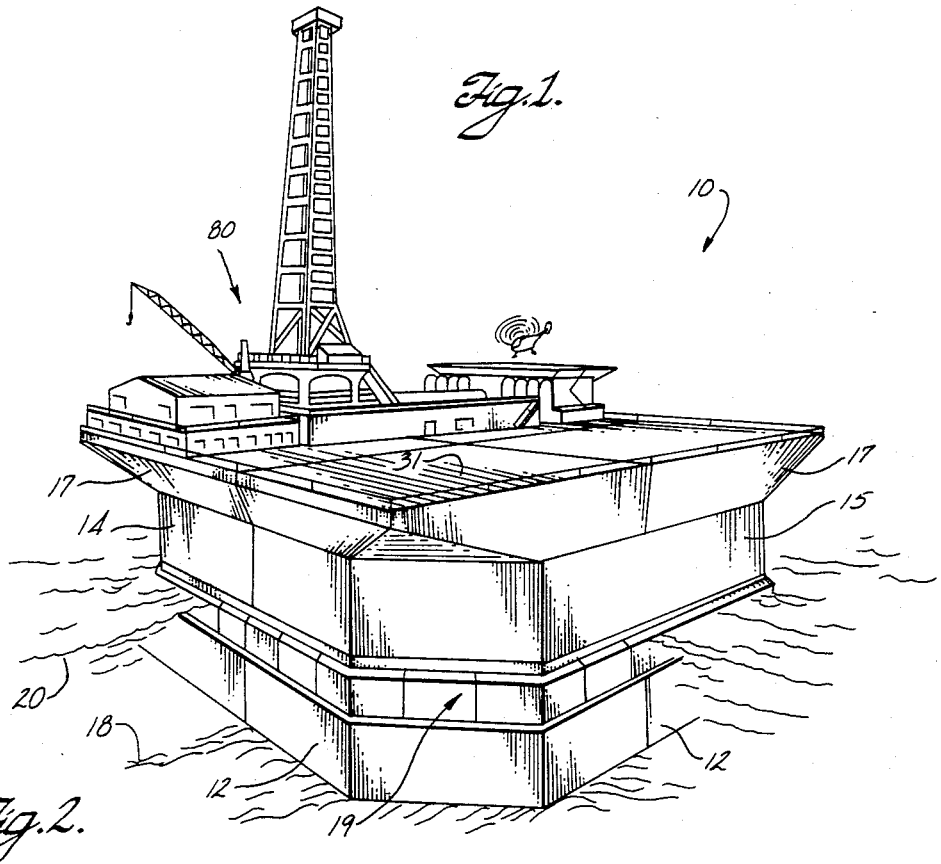
FIG. 1 is a perspective view of an offshore structure of this invention outfitted as an offshore drilling platform.

The presently preferred embodiment of this invention, and the mode of practicing this invention presently considered to be the best mode, involves the use of reinforced concrete to define the modular base units described hereinafter. Many of the features and benefits of this invention, however, are not dependent on the use of reinforced concrete base units. For purposes of explanation, and in compliance with applicable statutes, the invention is described herein, and depicted in the drawings, with reference to the presently preferred embodiment and perceived best mode which features reinforced concrete base units. However, if desired, and there may be circumstances where such could be desired, the base units may be fabricated of steel. Except where the following description, or the accompanying drawings, can reasonably be interpreted to pertain only to reinforced concrete (for example, the content of FIGS. 23 and 24 and the related text), the following description and the drawings are to be read and interpreted as being pertinent to the use of reinforced concrete or steel in the structural aspects of this invention.

An offshore gravity-type structure 10 according to the presently preferred practice of this invention is shown in FIG. 1. The structure provides an operations platform at a desired Arctic offshore site where operations of a specified nature are to be performed. When assembled and installed at the site as an operational entity, the structure carries a suitable operations facility 80 suited to the desired operations to be performed. Structure 10, as illustrated in FIG. 1, is outfitted and equipped with an operations facility which adapts the structure to be an offshore drilling platform for use in drilling of either exploratory or production oil and gas wells.

Figure 2:
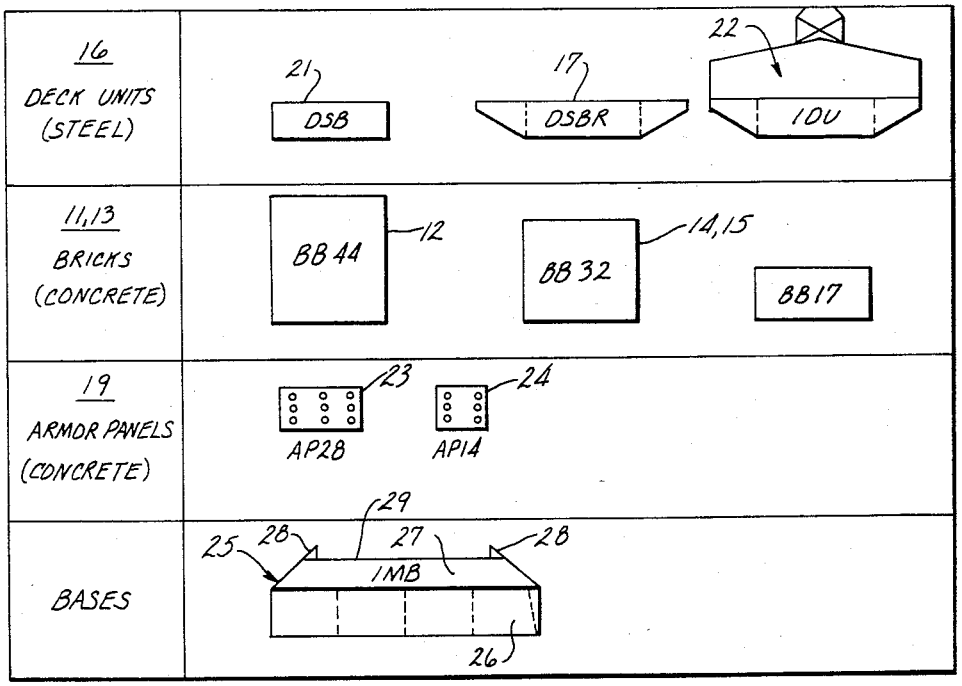
FIG. 2 is a chart showing the various major elements of the kit of components provided by the invention and assemblable into an offshore structure such as that shown in FIG. 1.
Figure 3:
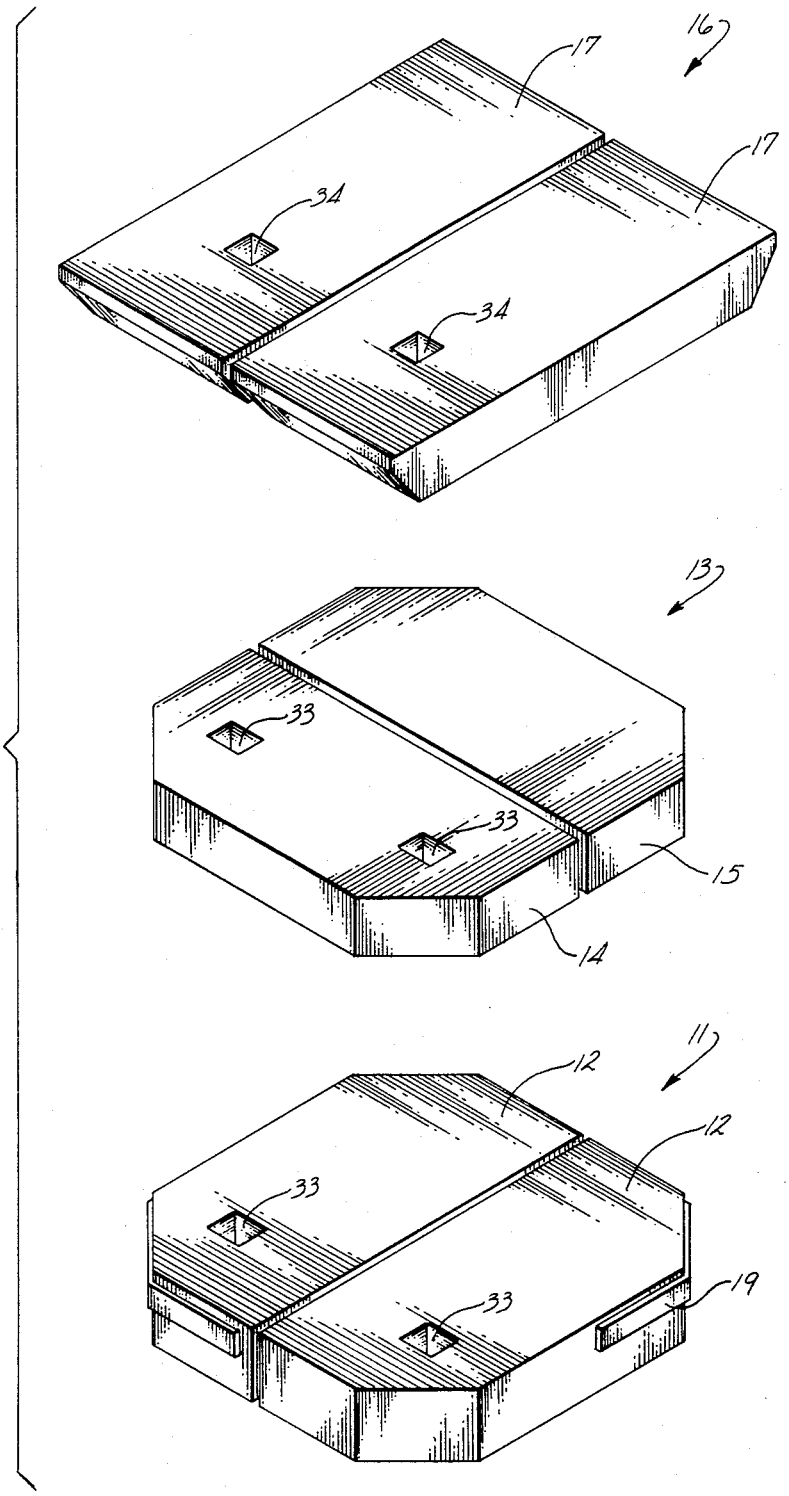
FIG. 3 is an exploded perspective view showing the relation of the major structural components of the offshore structure shown in FIG. 1.

FIGS. 1, 2 and 3 show that structure 10 is composed of a plurality of principal components arranged in a plurality of tiers to define the major aspects of the overall structure. Thus, structure 10 has a lower tier 11 composed of two lower base units 12 which are essentially identical as shown in FIG. 3. A central tier 13 is composed of two substantially but not precisely identical base units which are similar to lower base units 12. The structure has an upper tier 16 composed of two essentially identical major structural deck units 17. Units 12, 14, 15 and 17 are cooperatively interrelated, designed and dimensioned so that they collectively provide, upon mating together, a massive gravity-type structure having sufficient on-board water ballast mass that the structure forcefully engages a sea floor 18 at the intended site sufficiently to stand against environmental forces during long-term usage of the structure at the site in the Arctic.

The principal environmental forces of concern are ice forces applied laterally to the structure in a manner tending to move the structure away from its intended site. Forces which act in a manner tending to crush the structure are also of concern. An armor belt 19, composed of individual armor panels, is installed circumferentially of the structure at its mean waterline so that the belt extends a selected distance above and a greater selected distance below water surface 20. The armor belt is provided so that base units 12, 14 and 15 can be constructed with minimum material, while affording the overall structure 10 sufficient local strength in way of an adjacent ice sheet to withstand potential damage from applied ice forces.

The overall planform configuration of structure 10, especially through its central and lower tiers, is of a rectangular nature, preferably square, with chamfered corners. Since each of the tiers of structure 10 is defined by a pair of principal structural components of the structure, each of the components in a tier is of rectangular plan configuration, as shown in FIGS. 1 and 3.

In the presently preferred embodiment 10 of this invention illustrated in FIG. 1, each of base units 12, 14 and 15 are 234 feet long and 116 feet wide. The corners of these units are chamfered, i.e., relieved, by 42 feet 4 inches along the length and width of the respective base unit. Lower base units 12 are 44 feet high, whereas central base units 14 and 15 are 32 feet high.

FIG. 3 shows that the rectangular units in each of the substantially square tiers of structure 10 are turned at 90° to each other in terms of their length orientations in the respective tiers of the stack of components comprising structure 10.

FIG. 2 is a chart which shows that an offshore structure according to this invention can be defined to suit particular conditions of water depth, ice load and other environmental forces, and subsea soil conditions, among other pertinent factors, by appropriate selection of suitable components from an inventory of component parts. The inventory of component parts, in effect, provides a kit from which a particular offshore structure can be built initially or subsequently modified for use at another site. Constituents of the kit of components available and usable to define the upper tier of the structure include a simple, essentially rectilinearly configured deck storage barge 21 denoted DSB in FIG. 2, a deck storage barge with reserve storage capacity (provided by the addition of side sponsons to a DSBR) denoted DSBR in FIG. 2, and an integrated drilling unit (IDU) 22 which is essentially a DSBR outfitted prior to arrival at the intended site of use with superstructure and other equipment adapting the DSBR to the intended function of drilling of offshore subsea oil and gas wells. While not shown, another form of upper tier component would be a DSBR prefitted as a production facility for producing oil and gas from completed production wells; such a component would be an integrated production unit (IPU). Other yard-outfitted upper tier components suited for other operational uses are also within the scope of this invention.

Also with reference to FIG. 2, the components used to define the lower and central tiers, or only the lower tier of an offshore structure according to this invention, if appropriate, are referred to as "basic bricks", abbreviated BB in FIG. 2. The terms "basic brick" or merely "brick" are often used in the following description to refer to these components of a structure according to this invention. It is a feature of this invention that the bricks are preferably of honeycomb internal arrangement and are preferably fabricated of reinforced concrete. The bricks all have the same planform configuration and dimensions but are available in varying heights such as 44 feet, 32 feet and 17 feet; 44 foot and 32 foot high bricks are being used in tiers 11 and 13, respectively, of exemplary and presently preferred offshore structure 10.

The kit components useful to define armor belt 19 are also preferably constructed of reinforced concrete. The individual armor panels are of standardized height (12 feet in the preferred embodiment shown in FIG. 1), but are provided in two standard widths of 28 and 14 feet, respectively. In FIG. 2, these armor panels are designated as components AP28 and AP14, respectively.

FIG. 2 also illustrates the components available for definition of an offshore structure according to this invention which can, if desired, include an integrated mud base 25 denoted IMB. An IMB may or may not be used in an offshore structure depending upon the nature of the sea floor soils at the intended site of use. The ability of structure 10 to stand against expected ice sheet loads is a function of the mass of the structure as installed at the intended site and the effective coefficient of friction between the structure and the sea floor soil. In those instances where the sea floor soil has sufficient cohesion and integrity to be able to directly support the fully ballasted offshore structure without the use of an integrated mud base, then no such base would be used, and the bricks defining the lowermost tier of the structure would be landed directly upon the sea floor. In other locations, however, the sea floor soil may be inadequately consolidated, or otherwise inadequate, in combination with the mass of the fully ballasted offshore structure, to either directly receive the offshore structure or to provide the desired coefficient of friction to enable the structure to stand against expected ice loads, or both. In such circumstances, an IMB is used to distribute and spread the mass of the offshore structure, as shown in FIG. 1, over an extended area of the sea floor soil. An IMB, if used, is constructed of steel, preferably, and includes a lower, substantially annular depending skirt portion 26 configured to penetrate into the adjacent sea floor soil, and a structural mat portion 27 of suitable horizontal and vertical dimensions (in the range of 10 to 25 feet high) selected with reference to the specific soil engineering problem presented at the site and for which the individual IMB is designed. The outer walls of the mat portion of the IMB slope upwardly and inwardly. Suitable chocks or other keying projections 28 extend upwardly from the upper surface 29 of the IMB mat portion 27 to engage the side walls of the lowermost basic bricks of the pertinent offshore structure.

Thus, FIG. 2 illustrates an important feature of this invention, namely, that the principal structural components of an offshore platform according to this invention are of standardized dimension and functional arrangement, and are provided as functional modules which, by judicious selection, can be assembled to provide an offshore structure specifically suited to the water depth, environmental force, sea floor conditions, and other factors pertinent to a particular site and a particular operation of interest. The only nonstandard substantial component of an offshore structure according to this invention is the optional integrated mud base which is, in essence, customized to particular soil engineering considerations at a particular site.

Figure 5:
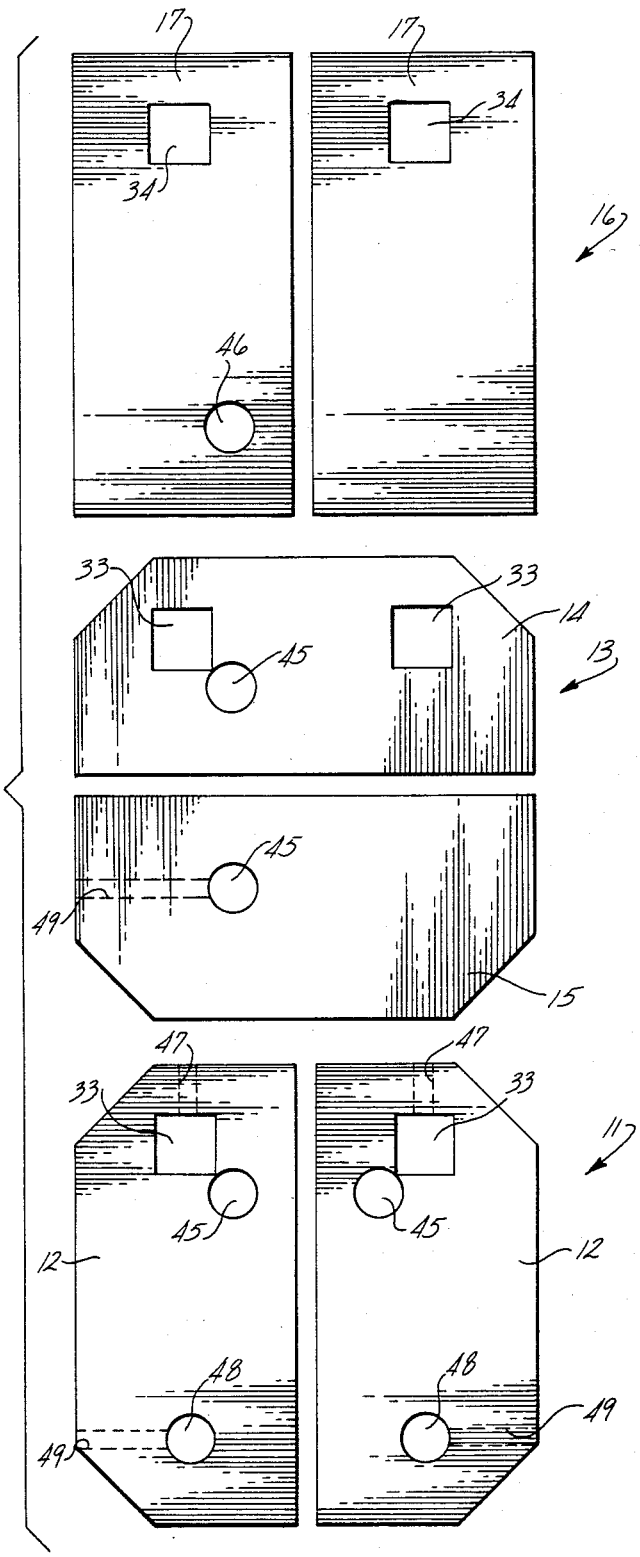
FIG. 5 is a group of plan views of the lower and base units, and of the deck storage barges comprising the structure of FIG. 1, and which shows the vertical relation of access and other features.

As noted above, the exemplary offshore structure shown in FIG. 1 is outfitted as a production offshore drilling platform. It is usual that from such a platform a number of wells are drilled from which oil and/or gas will be produced. Accordingly, in order that structure 10 can have maximum flexibility and utility when used as an offshore production drilling platform, its principal structural components are arranged to define a pair of moonpools, i.e., passages which extend vertically through the structure friom its upper deck 31 to its lower surface as defined by the bottom surfaces of the lowermost tier of bricks used in the offshore structure. In the exemplary structure shown in FIGS. 1 and 3, for example, the moonpools are 28 feet square, and are defined by vertical passages 33 through the bricks in the structure. There is one passage 33 through each of bricks 12, two such passages through brick 14, but none through brick 15—see FIG. 3. Similarly, vertical passages 34 of the same dimensions as passages 33 are defined through each of DSBR units 17, as shown in FIGS. 3 and 5. Upon stacking of the deck units and bricks in a given offshore structure, passages 33 and 34 are aligned along common axes to define the desired moonpool features.

Figure 4:
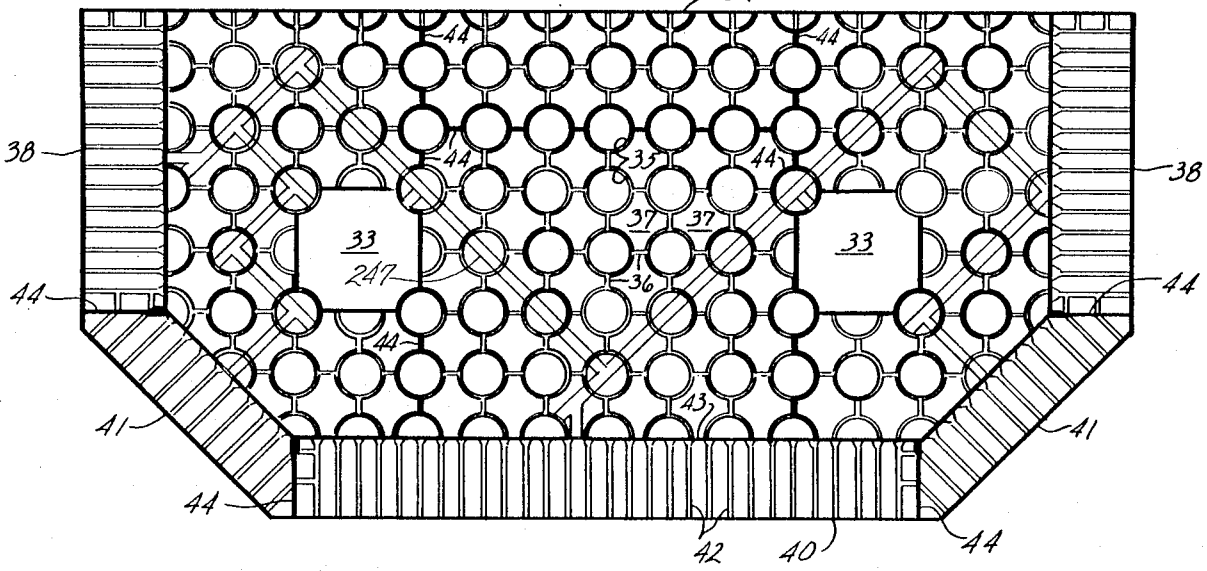
FIG. 4 is a cross-sectional plan view of one of the upper base units of the structure shown in FIG. 1, a cross-sectional plan view of one of the lower base units of such structure being similar to the content of FIG. 4.

FIG. 4 is a cross-sectional plan view of base unit 14, the internal construction of which preferably is of the honeycomb type; as noted above, the base unit bricks are preferably fabricated essentially entirely of reinforced concrete. The honeycomb construction of each brick results in a unit which is very strong, while also being light. As shown in FIG. 4, the internal structure of base unit 14 (to which all bricks are similar) is predominantly defined in accordance with the teachings of U.S. Pat. No. 3,833,035 in that it is comprised of a plurality of regularly spaced circularly cylindrical vertical cells 35 which are interconnected in orthogonal directions by intercell webs 36 which cooperate to define further cruciform cells 37 within the base unit. Each base unit has opposite parallel, flat, vertical end walls 38, and vertical, flat major and minor side walls 39 and 40. Major side wall 39 extends continuously between the base unit end walls, whereas the minor side wall 40 is connected to the unit end walls via vertical and substantially flat corner walls 41 which lie at angles of 45° to the adjacent end and side walls.

The end, minor side, and corner walls of a base unit will be exposed in use to environmental forces, notably ice forces. To enhance the ability of the base units to resist applied ice loads, and to distribute such applied ice loads into the remaining structure of the base unit, the interior structure of each base unit immediately adjacent to walls 38, 40 and 41 is defined by a plurality of vertical parallel shear walls 42 which extend from the inner surfaces of the adjacent outer walls of vertical bulkhead walls 43. Bulkhead walls 43 are located approximately 19 feet inboard from the adjacent outer walls of the base unit; the remaining major portion of the interior volume of each base unit is defined by the combination of circular cells 35 and intercell webs 36. The entirety of the interior of each base unit is of a generally honeycomb structural arrangement.

Circular vertical cells 35 preferably are 10 feet in diameter and are spaced on 14 feet centers longitudinally and transversely of the base unit. Shear walls 42 preferably are located on 4 foot 8 inch centers. Interior watertight partitions within each base unit are provided by bulkheads 43 and by additional bulkheads 44, shown in FIG. 4, which are arranged to define nine watertight compartments. The other bricks and the deck barge units are similarly internally compartmented which serve as ballast spaces.

Ballast pumps, manifolds, and control valves are located within a manifold chamber 45 defined within each base unit 12, 14 and 15, as shown in FIG. 5. Each manifold chamber is connected to the ballast chambers of the corresponding base unit by suitable piping within the base unit. As shown in FIG. 5, the manifold chambers 45 are located in the several base units in such manner that when the base units are stacked, the various manifold chambers are accessible either from the top (as in the case of base unit 14 via a suitable hatch 46 provided in the bottom of one of deck units 17) or via the moonpool of the pertinent base unit. Access from the moonpool passage into a manifold chamber is provided by a double-entry bolted hatch assembly mounted in the common wall between each moonpool passage 33 and the adjacent manifold chamber. Each of the ballast chambers within each base unit is accessible from that base unit's manifold chamber via a network of catwalks 247 (see FIG. 4) which are installed through and into various ballast chambers. Access from the manifold chamber to the catwalk network is provided by suitable double-entry bolted hatches.

Appropriate openings are provided through the non-watertight shear walls and bulkheads of each base unit for purposes of flow of water and air between the cells of the base unit, and to provide access via the catwalks for personnel. The catwalks are located in the upper portions of each base unit.

Each deck storage barge 17 is also equipped with ballast pumps, manifolds, valves and piping.

As shown in FIG. 5 with reference to bottom base units 12, a ballast suction duct 47 communicates in each base unit from the moonpool duct passage to the exterior of the base unit. Also, one of the circular cells in each base unit which is incapable of being used as a bottom tier base unit is defined as an inlet sump 48 which has communication to the exterior of the base unit by a suitable duct 49 extending between the ballast sump and an outer wall of the unit. As a practical matter, every base unit provided in the kit illustrated in FIG. 2 is capable of being used as a bottom base unit. Therefore, every base unit which has a moonpool passage 33 vertically through it is equipped with a lateral suction duct 47 for use in ballasting the base unit, particularly after the base unit has been engaged with the sea floor or the upper surface of another base unit.

To facilitate assembly and installation of offshore structure 10 at an Arctic location, as well as to simplify the logistics of transporting the structure components from remote sites of fabrication, the deck units of the offshore structure are designed as submersible barges capable of transporting the heaviest base units in the system, i.e., base units 12 (BB44 units). This is the case whether the deck units are of the simple DSB type (item 21 in FIG. 2) or the greater capacity DSBR units (item 17 in FIG. 2).

From the description of the invention to this point, it will be appreciated that the major components of an offshore structure according to this invention are quite large. There are no facilities presently existing, or likely in the near future to exist, in the Arctic suitable for construction of these components. The components must necessarily be built in existing shipyards or other suitable construction facilities, all of which are located in temperate and tropic areas. It will also be appreciated that each tier of the offshore structure could be defined as a unitary component (see FIG. 37) rather than as a pair of components; such a component would be very large and would weigh, dry, as much as 30,000 tons or more; facilities for the fabrication of such a large reinforced concrete construction do not presently exist adjacent suitable waterways, with only several possible exceptions.

Accordingly, while the inventive scope of this invention extends to an offshore structure having single component tiers, it is presently preferred that the tiers of an offshore structure according to this invention be defined by two or more components in order that the components can be manufactured in a much larger number of shipyards and similar facilities which exist worldwide, including in the United States and Canada. Following construction remote from the Arctic, the components are towed to an assembly location selected as closely adjacent to the site of intended use as possible. The design and construction of deck units 17 or 21 as transport barges for the base units contribute to the economy and efficiency of the present invention. Construction of both the base unit bricks and the DSBs or DSBRs can be accomplished in most areas of the Pacific perimeter. Since the width of each unit is only 116 feet and the maximum light ship weight is 16,000 tons, the major modular components of the offshore structure can be competitively bid by a large number of shipyards and construction sites in this area. Both the width and draft of the individual base unit bricks are such that the necessary tows can be easily integrated into the normal sealift of personnel and material to the United States and Canadian Arctic North Slope.

Deck units 17 or 21, considered as submersible barges, are so defined that one of the most massive of the bricks, which has a dry weight of approximately 16,000 short tons, can be loaded aboard a corresponding barge to be towed dry to an Arctic assembly location adjacent the intended site of use. The lighter base units, such as the BB32 units which weigh approximately 11,000 short tons, or the even lighter BB17 units, can be transported to the Arctic North Slope area on available commercial submersible barges. As the base units are loaded aboard the respective submersible barges, all ancillary hardware useful in the base unit mating procedure will also be installed or loaded.

Figure 6:
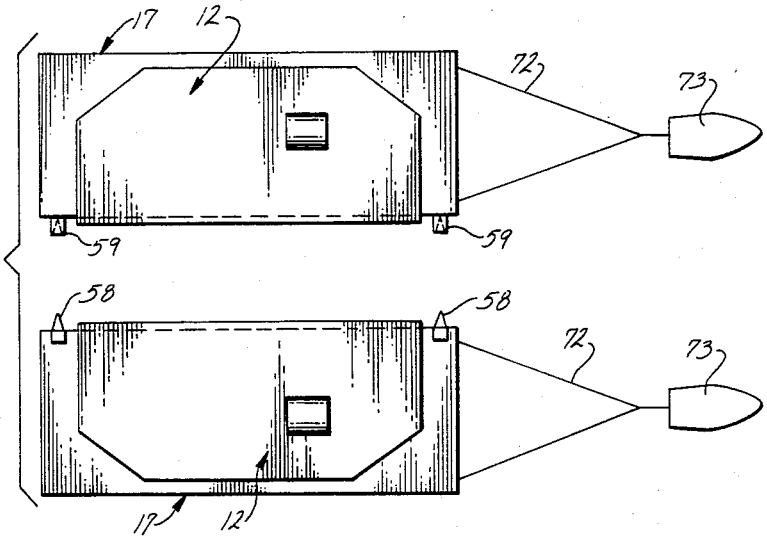
FIGS. 6, 7, and 8 are simplified illustrations depicting steps in the interconnection between base units in a common tier of the offshore structure shown in FIG. 1.
Figure 7:
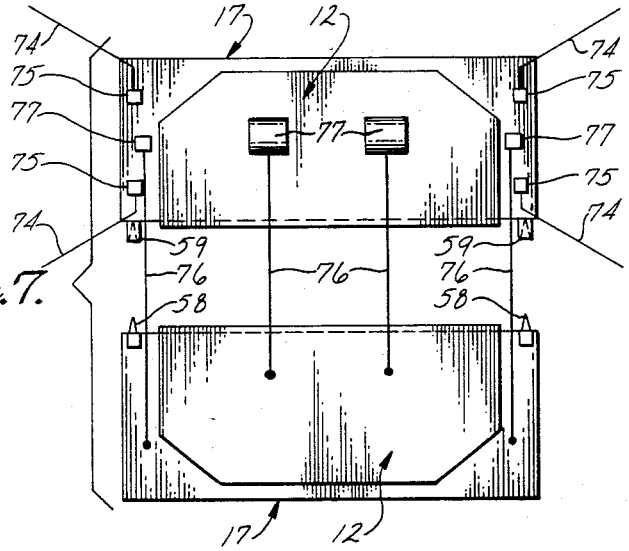
Figure 8:
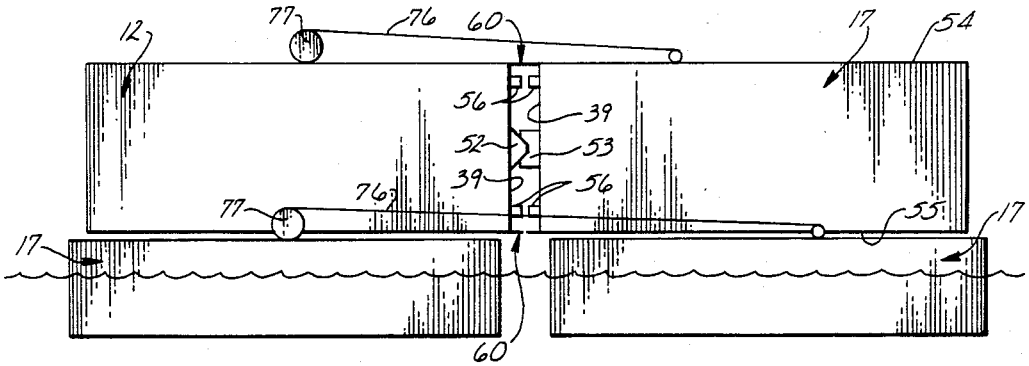
Figures 10, 11, 12, 13, 14, 15, 16, 17, 18, 19:
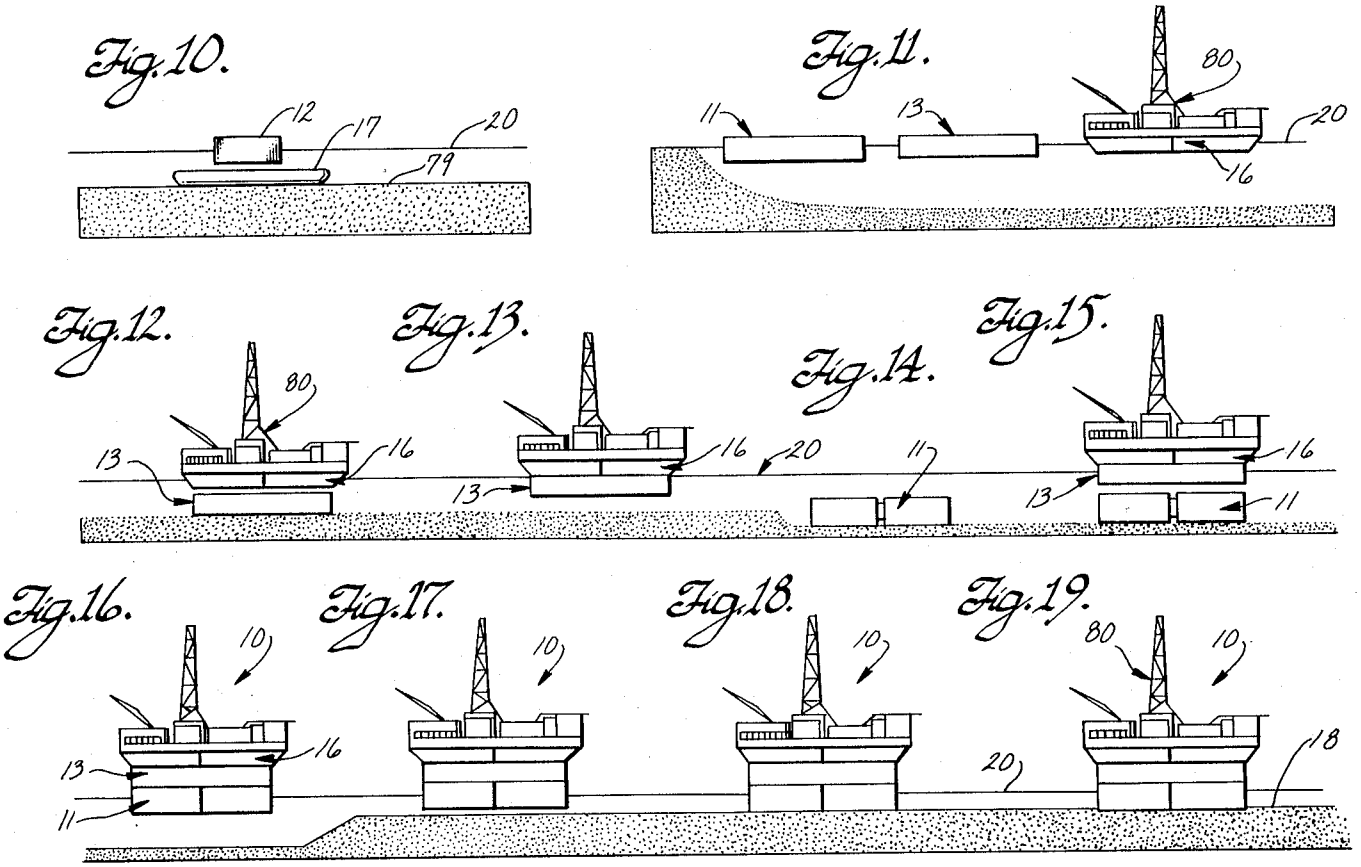
FIGS. 10 through 19 are simplified elevation views showing sequential stages of a procedure for assembling and installing the structure of FIG. 1.

The generalized procedure for stacking the base and deck units of offshore structure 10 is shown, in sequence, in FIGS. 10 through 19, and certain procedures preliminary to the stage of operations illustrated in FIG. 10 are shown generally in FIGS. 6, 7 and 8.

During the construction of base units 12, for example, certain features are defined in them along their major side surfaces 39 to facilitate their mating and interconnection. These features include at least a pair of mating pin 52 and socket 53 features at spaced locations along the base unit major sides; see FIG. 8. All of pins 52 may be defined in one of the base units, and all of the sockets 53 may be defined in the other of the base units, but it is preferred, in order that each base unit of a given size can be interchangeably matable with any one of a number of other base units of the same nominal size, that the pins and sockets be defined by both of the interconnected base units. The pins and sockets co-act with each other, in the manner shown in FIG. 8, to secure the mated base units from relative motion toward each other horizontally, from longitudinal relative motion, from relative motion vertically, and from angular motion about a horizontal axis perpendicular to the base unit major side walls. Also, at spaced locations along the length of each base unit adjacent its top 54 and bottom 55 surfaces, the base units define cooperating bumper stop projections 56. The bumper stop projections abut each other upon mating of two like or substantially like base units to limit angular motion between the base units about horizontal and vertical axes disposed parallel to side surfaces 39. Where, as preferred, the base units are fabricated of reinforced concrete, bumper stop projections 56 are formed as a part of the concrete casting fabrication process pertinent to each base unit; pins 52 and sockets 53 may also be formed of concrete or they may be steel fixtures applied to the base units after the concrete casting phase or other pertinent portion of the fabrication process has been completed. Features 52, 53 and 56 are proportioned so that, when they are mated and abutted, a space about two feet wide is provided between walls 39 of the adjacent base units; this space is adequate for access between the base units during interconnection of the units.

At the location where the base and deck units are constructed, each completed base unit 12, for example, is disposed on the upper surface of a corresponding barge DSB or DSBR in such a manner that, as shown in FIGS. 6–8, the major side surfaces 39 of the base units are disposed outboard of the adjacent sides of the barge by, say, one or two feet. This is done to provide access, during the process of mating and interconnecting the base units, to the base unit interconnection assemblies 60 (shown in FIG. 9) located along the bottoms of the base units; access is inherently available to the interconnection assemblies at the upper portion of the interface between horizontally adjacent base units.

Similarly, as shown in FIGS. 6 and 7, the deck unit barges also include cooperating aligning and mating features along the sides which are overhung by the major sides of the base units. Thus, as shown in FIG. 6, a pair of mating guide cones 58 are carried by one of barges 17 at selected locations along its length, preferably adjacent the ends of the base unit, while the other barge is fitted with cooperating guide cone sockets 59. Cones 58 and sockets 59 preferably are securely, yet releasably, affixable to the respective barges. They are first installed on the barges at the base and barge fabrication site for purposes or preliminary alignment and mating of the base units for the purposes which are described below. Thereafter, they are removed for transit of the loaded barges to the location of assembly of offshore structure 10. At such location, they are temporarily reconnected to the barges to serve their intended functions during the final base unit mating and interconnection process.

As represented in FIG. 8, a plurality of horizontal bolted connection assemblies 60 are provided at spaced locations along the interface between the base units in a given tier of offshore structure 10 at or adjacent both the upper and lower extents of the interface. If desired, vertically disposed bolted connection assemblies, similar to assemblies 60, also may be provided between cooperating base units at or near the opposite ends of the interconnection interface. Details of a suitable interconnection assembly 60 are shown in FIG. 9 with reference to a top horizontal bolted interconnection assembly.

Figure 9:
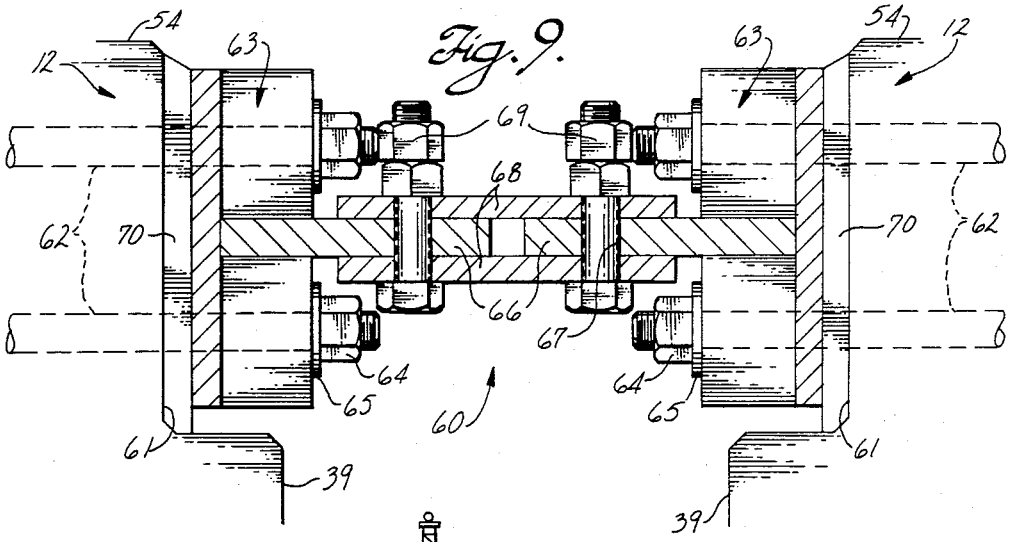
FIG. 9 is a cross-sectional elevation view of a bolted connection between adjacent base units in a tier of the structure shown in FIG. 1.

As shown in FIG 9, in way of each bolted interconnection assembly, the outer surface of each base unit major side wall 39 is recessed, as at 61. Suitable bolting studs 62 are cast into or otherwise affixed to each of the base units to project horizontally along carefully positioned axes into and beyond the recesses. One of a pair of joint weldments 63 is secured on each set of bolting studs by nuts 64 and washers 65. Each joint weldment defines a horizontal bolting flange 66 through which vertical bolting holes 67 are defined at predetermined locations along the pair of joint weldments 63. The flanges are disposed in coplanar relation and are interconnected by top and bottom joining plates 68 which are drilled to define a plurality of holes corresponding in number and pattern to the number and pattern of holes 67 in the cooperating flanges 66. The top and bottom joining plates and the bolting flanges are interconnected by suitable nut and bolt sets 69, as shown in FIG. 9.

At the location where the base units are initially loaded upon their transport barges, e.g., deck unit barges 17, each interconnection assembly is fully made up in a semi-tight condition in such manner that the joint weldments 63 are disposed outwardly along studs 62 from recess surfaces 61, thereby to define a gap between the respective joint weldments and recess surfaces. These gaps are filled with a hard-setting grout 70 which is allowed to hard set before the interconnection assembly is partially disassembled prior to transit of the base units to the site of final mating and assembly. Thus, at the location where the base units are prepared for transit to the final area of use, each interconnection assembly is adjusted and finally defined before disconnection of the assembly for transit by removal of nuts and bolts 69 and top and bottom joining plates 68. At this point, a given pair of base units become an essentially matched set. It will be appreciated, however, that any base unit of a given size can be adapted for interconnection with any other base unit of the same nominal size simply by disconnecting the joint weldment 63 from that base unit and by chipping out grout 70 to ready the base unit for "customizing" into matched set status with any other base unit.

After the several bolted interconnection assemblies have been adjusted and temporarily disconnected, the mating guide cone 58 and socket 59 fittings for the corresponding deck unit barges are removed, as by unbolting, and suitably stored aboard the barges for transit. The barges, each with a base unit 12 disposed thereon, are then coupled via suitable towing bridles 72 to tugs 73 or the like for towing to the Arctic site of intended use. See FIG. 6.

Upon arrival of the base units at the Arctic site of mating and assembly, the submersible barges re re-fitted with their mating cone and socket units 58 and 59, as shown in FIG. 7. One of the barges is moored in an essentially fixed position by use of mooring lines 74 and suitable winches 75 as shown in FIG. 6. The two base units and barges are then interconnected by suitable cables 76 and winches 77 so that the unmoored barge can be drawn, under careful control, toward and into mating engagement with the moored barge and its base unit. Precise positional alignment and mating of the barges with each other is accomplished via cones and sockets 58, 59, whereas similar mating alignment of the deck units with each other is assured by cooperation between pins 52 and sockets 53, and by cooperation between bumper stops 56. Such mated alignment between the barges and base units is maintained by keeping tension on cables 76 while bolted interconnection assemblies 60 are reassembled. This, then, presents the state of affairs which exists adjacent to the final site of use of the offshore structure prior to the stage of mating and assembly illustrated in FIG. 10.

As shown in FIG. 10, the final mating and assembly of the major components of offshore structure 10 is carried out adjacent to, but in waters deeper than, the final site of use of the structure. After a pair of bottom base units 12 have been mated and interconnected, the two submersible deck unit barges 17 are controllably ballasted to become decreasingly buoyant, then neutrally buoyant, and then slightly negatively buoyant, so that the deck unit barges sink away from base units 12 to rest upon sea floor 79. In this manner, the interconnected bottom base units 12 are rendered free-floating in an essentially unballasted state. The free-floating bottom base units are then moved from over the submerged barges to a location of temporary anchorage. The barges are then refloated and moved to a nearby location where they are mated and interconnected according to a procedure similar to that described above. The interconnected deck unit barges may then be outfitted with the desired superstructure and deck equipment to define the desired operations facility which, in the case of offshore structure 10, is an exploration drilling facility. The outfitting of the interconnected deck unit barges preferably is carried out in parallel with the interconnection of the two base units defining the central tier 13 of base units of structure 10.

Either concurrently with or following completion of the operation illustrated in FIG. 10, base units 14 are moved to a suitable mating and interconnection location on their submersible transport barges. Such base units are interconnected generally in the manner described above.

FIG. 11 depicts tiers 11, 13 and 16 of offshore structure 10 free floating on the ocean surface as discrete subcombinations of components of the desired ultimate structure. FIGS. 12–16 show the steps in the final mating and assembly of the various tiers of structure 10 into the fully assembled structure at FIG. 10.

To commence the final mating and assembly of structure 10, central tier 13 is moved into waters having a depth slightly in excess of the height of tier 13 and the light-ship draft of tier 16 as outfitted with the basic structural features of operations facility 80; in the instance where the central tier is composed of BB32 units, a suitable water depth is on the order of 37 feet. At such location, the internal ballast systems of tier 13 are utilized to controllably ballast the tier to a negatively buoyant state to place it on the sea floor in a fully submerged condition. The upper tier 16 is then floated into position over the submerged central tier, disposed in the proper orientation relative to the central tier, and keyed into position relative to the central tier, as by use of the guide pin assemblies shown in FIG. 20. Then, the internal ballasting systems of upper tier 16 are operated to sink the upper tier into contact with the upper surface of the central tier. The ballast state of the upper tier is maintained as the central tier is unballasted to render the combination of tiers positively buoyant so that such combination can float free of the sea floor to the condition depicted in FIG. 13.

Once the combination of tiers 13 and 16 has floated free of the sea floor, deballasting of tier 13 is continued at least until the combination has risen sufficiently in the water that deballasting of upper tier 16 can be commenced and pursued without risk of reducing the intertier contact forces which are always relied upon to secure the tiers together.

Next, lower tier 11 is moved into waters having a depth in excess of the height of the sum of the lower tier height and the pertinent draft of the combination of tiers 13 and 16. Where the lower tier is defined of BB42 base units, a suitable water depth is on the order of 64 feet. The lower tier is then rendered negatively buoyant in a controlled manner and positioned on the sea floor as shown in FIG. 8. Next, as shown in FIG. 9, the combination of the central and upper tiers of structure 10, as previously mated together, is floated into position over submerged lower tier, disposed in the proper angular relation to the lower tier, and controllably ballasted into proper mating engagement with the lower tier. Again, in this mating operation, pins 82 (see FIG. 20) are used. Once mating of the lower tier with the combination of the central and upper tiers has occurred, the lower tier is deballasted, with subsequent deballasting of the central and upper tiers as needed, to cause the now essentially fully assembled offshore structure 10 to float free of the sea floor. At this point, the assembly will have a draft less than the water depth at the site of intended use of the offshore structure and the water depth along the path of movement between the site at which the operations depicted in FIG. 9 have been performed and the intended site of use. The fully assembled, but not yet finally installed offshore structure is then floated, as shown in FIG. 11, to the intended site of use where, as shown in FIG. 12, it is ballasted into engagement with the sea floor. Thereafter, all of the ballast spaces of the offshore structure are filled, either fully or to the extent necessary, to cause the landed offshore structure to achieve its design deadweight, thereby to produce the desired forceful engagement of the landed structure with sea floor 18 adequately, in combination with the coefficient of friction provided between the structure and the sea floor soils, to enable the offshore structure to stand against horizontal loads applied to the structure by ice during the following ice seasons over the period during which the offshore structure is in use at that site. After full ballasting of the installed offshore structure, stores, supplies and operational liquids, including all fuel, potable water, and other materials required, are loaded aboard the offshore structure.

Offshore structure 10, as shown in FIG. 1, has been designed, principally in the context of the deck units 17, to provide sufficient storage capability, deck space and capacity to support at least four months of operation on site without major resupply.

Offshore structure 10 and its installation procedures are designed so that the structure can be operational within 30 to 42 days after arrival of its major components in the Arctic.

Figure 20:
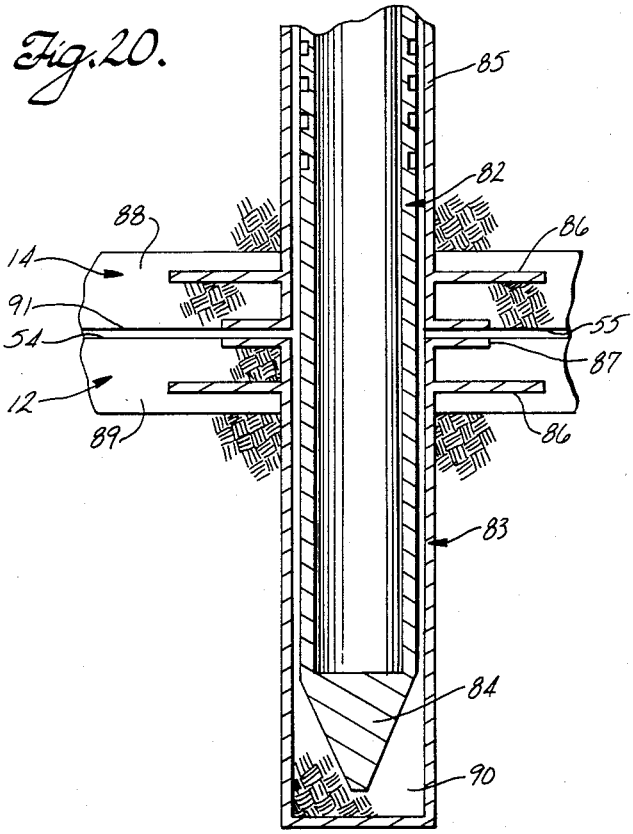
FIG. 20 is an enlarged fragmentary cross-sectional elevation view of the interface between vertically stacked base units at a positioning station between the units in the structure shown in FIG. 1.

A plurality of positioning and shear pins 82, shown in cross-section in FIG. 20, are installed between vertically adjacent components of offshore structure 10 during the course of mating and assembling the components according to the procedure described above. The pins enable precise alignment of vertically adjacent components, and also provide substantial resistance to shear and lateral relative motion between the components along the horizontal interface 91 between them in the assembled structure. The shear pins are disposed at selected locations in the components in the central and upper tier components of structure 10 for registry in upwardly open sockets 83 disposed at corresponding locations in the upper surfaces of the bottom and central components. Pins 82 preferably are provided in the form of heavy-wall steel pipes of, say, 30 inch diameter, and have pointed lower ends 84; if desired, the pins can be solid. Pins 82 are carried in vertical guide sleeves 84 which open downwardly through the lower surface 55 of the component within which they are carried. Sockets 83 and guide sleeves 85 preferably are fabricated of steel pipe which has an inner diameter greater than the outer diameter of pins 82 by an amount which is selected consistent with the tolerances realistically capable of observation in constructions having the size and nature here pertinent. The sockets and guide sleeves are permanent features of the respective components of structure 10; in the instance of the reinforced concrete base units, the sockets and sleeves are cast into the upper and lower portions of the base units, respectively. The base unit sockets and guide sleeves have circumferential mounting flanges 86 and 87 at their opposing ends, such flanges being embedded in the concrete defining the lower 88 and upper 89 slabs of the base units. Also, it is preferred that at least flanges 86, which lie within the thickness of the adjacent slab, be securely connected to the steel reinforcing bars (not shown in FIG. 20, but see FIG. 30, for example) of the slab.

Prior to mating of a base or deck unit with another base unit in final assembly of structure 10, pins 82 are carried wholly within their corresponding guide sleeves. At the time a component carrying pins 82 is positioned above a component with which it is to be mated, the pins are partially lowered to project a selected distance below the bottom surface of the corresponding component. The pins are secured in their guide sleeves in such partially lowered positions in a suitable manner. The upper ends of sleeves 85 are closed in the event that the sleeves do not extend to the upper surface 54 of the component within which the sleeves are carried. Closure of the upper ends of sleeves 85, in the instance where the sleeves do not extend to the upper surface of the pertinent component, is desired so that the annulus between the exterior of each pin and its guide sleeve does not provide a path for entry of sea water into the component during the ballasting procedures pertinent to mating of vertically adjacent components in structure 10.

The projection of the lower ends of the guide pins below the bottom surface of the corresponding deck or base unit facilitates registry of the pin ends with the upper ends of sockets 83 so that precise positioning, within acceptable tolerances, of the components to be mated is accomplished with ease and dispatch. If desired, a quantity of sand 90 or similar material can be disposed in the closed lower end of each socket 83 to provide for firm seating of the pins in the sockets upon final lowering of the pins after component mating has occurred.

Figure 22:
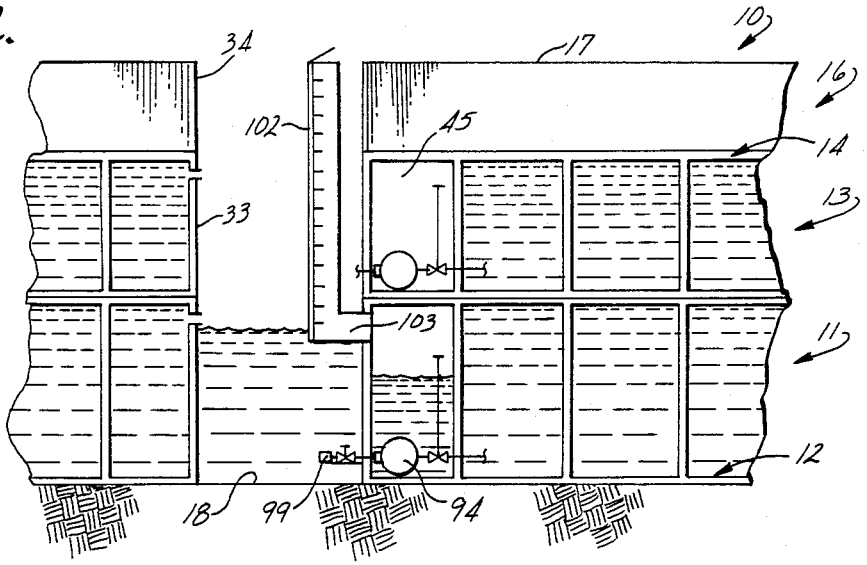
FIG. 22 is a view similar to FIG. 21 showing another aspect of the base unit ballasting apparatus.
Figure 21:
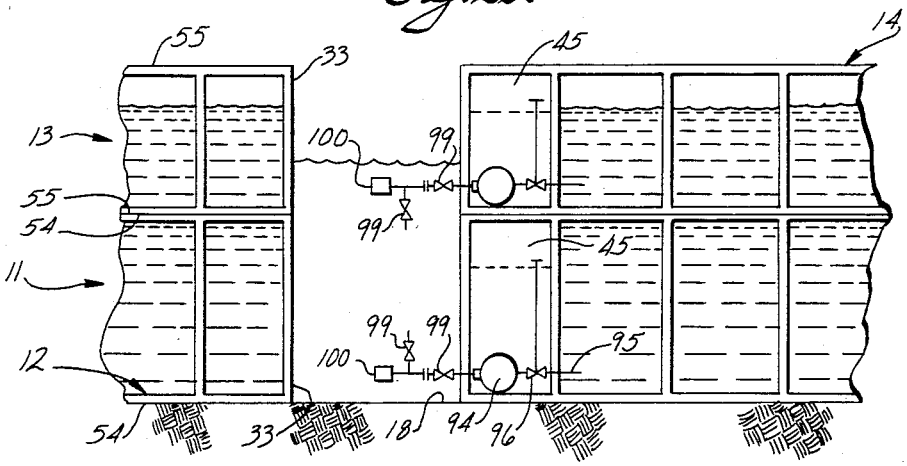
FIG. 21 is a fragmentary cross-sectional elevation view through a moonpool of the structure of FIG. 1 showing an aspect of the base unit ballasting apparatus.

FIGS. 21 and 22 are simplified cross-sectional elevation views showing the base units defining the lower and central tiers 11 and 13 mated together with the lower tier base units resting on sea floor 18, and with the ballast spaces of these base units fully or partially ballasted. FIGS. 21 and 22 illustrate different stages in the procedure for ballasting and deballasting the base units in the course of initially mating and assembling structure 10 and in placing the fully assembled structure at its intended site of use. FIG. 21, for example, shows that, in each of the ballastable components of structure 10, the manifold and valve chamber includes a main ballast header manifold 94 in the lower part of the chamber. Each manifold 94 is connected via ballast pipes 95 to each ballast space within the component via a corresponding valve 96 located within the lower portion of chamber 45 and operable, via a reach-rod, from an upper portion of the chamber at the catwalk level. Each header manifold has two valved connections 97, 98 (see FIG. 38) to the exterior of the component adjacent its lower surface 54. Connections 97 and 98 are to the moonpool passage of the component if the component is one which has a moonpool passage.

While not shown in the accompanying drawings, it will be appreciated that each ballast space in the ballastable components of offshore structure 10 has an air vent connection from its upper portion to the exterior of the component. If the component defines a moonpool passage, all ballast space vents are to the moonpool passage. Each vent pipe terminates at a guick-disconnect "Kamlock" connector fitting which is accessible from the exterior or moonpool passage of the component. Suitable vent hoses, equipped with corresponding connector fittings, are engageable with the vent termination fittings to provide communication from the vent pipe from each ballast space to atmosphere even when the corresponding base unit is fully submerged. In this way, each ballast space in the components, especially in bottom base units 12, can be fully ballasted or deballasted even when fully submerged.

It will also be appreciated that, consistent with the use of water ballast in the several components of structure 10, and consistent with the focus of this invention upon structures suitable for year-round offshore use in Arctic waters, the ballast spaces in the base and deck unit components of the structure are each equipped with heat exchangers which are elements of a ballast water heating system (not shown). In many, if not most uses of structure 10, the ballast spaces in its components will be fully filled with sea water ballast, thus affording no room for ballast water expansion due to freezing. The heating system also includes liquid phase heaters (preferably diesel fired), circulating pumps, system pressure sets and controls, major aspects of which are located in the operations facility on the upper deck of the assembled and installed structure. Each ballast space in the base and deck units is equipped with a heating coil connected to the heaters and pumps via supply and return headers located in the manifold chamber 45 for the respective unit. A control panel is provided on which is displayed the temperature of water in each ballast space as measured by suitable sensors. A thermally controlled three-way valve with manual preset and ballast space temperature feedback serves to automatically maintain the desired water temperature in each ballast space. It is presently preferred to use four independent, but cross-connectd, closed loop, pressurized fluid heating systems in the preferred structure; each independent heating system preferably includes a 2,500,000 BTU diesel fired heater for the circulating fluid. Selected portions of the inner surfaces of the ballast spaces are insulated to reduce the energy required to maintain the ballast water at about 35° F. during periods when the ballast water heating system is used.

The ballast and vent systems provided in the brick components of structure 10 are sized to provide sinking of a brick, or brick pair, in 9 to 12 hours by free flooding and pumping. The ballast piping 95 to the ballast spaces is sized to provide a uniform flooding rate in each space. The actual flooding time required in any particular situation will depend upon the particular flooding sequence selected. The ballast and vent piping systems afford controlled flooding and draining of the ballast spaces within each base unit and in the deck units. The ballast systems are required both when the base unit bricks are grounded with the base unit top surface 55 above the water surface, and also on those occasions when the base unit bricks must be fully submerged. Accordingly, the ballast systems are configured to enable fill and drain operations to be performed without the need to enter watertight compartments or to operate system valves from the upper surface of a base unit.

Figure 38:
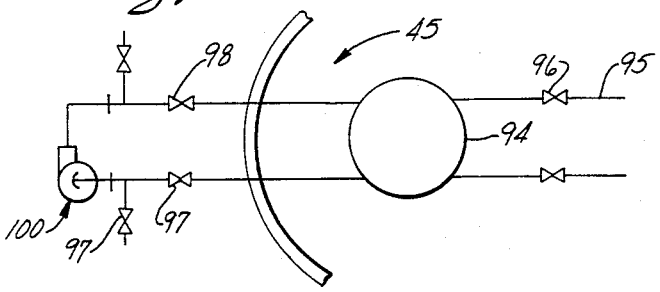
FIG. 38 is a fragmentary, cross-sectional plan view of a valve and manifold chamber in a base unit, for example, showing aspects of the unit ballasting apparatus not shown in FIGS. 21 and 22.

Portable electric submersible pumps 100, preferably rated at about 4000 gpm and powered by portable electric generators, are used to ballast and deballast the several modules of the offshore structure. As shown in FIG. 38, which is a fragmentary cross-sectional plan view of a base unit manifold chamber 45, valves 97 and 98 are connectible to the suction and discharge ports, respectively, of a submersible pump 100 via connections which each include a sea valve 99. By this arrangement, the ballasting system for each base and deck unit in structure 10 can be operated to draw in or discharge ballast sea water from and to the sea as required.

When a base unit is free floating, its lower valved connections 97, 98 to ballast header manifold 94 will be below the waterline of the base unit. Opening of these connections and their attendant sea valves (not shown), and suitable operation of control valves 96, will enable the base unit to be ballasted in a free-flooding mode. By closing valve 97 and the sea valve in connection 98 and energizing the pump 100, water can be injected in a controllable manner to assume a condition of negative buoyancy in which the base unit comes to rest on sea floor 18 in a fully submerged condition. In the case of initial mating and assembly of the several components of structure 10, the ballasting operations for a base unit will be discontinued at that point since, during initial mating and assembly, it is not necessary to fully ballast a grounded base unit. Mating of the interconnected central units 14 with the grounded pair of interconnected bottom base units 12 can also be accomplished by use of the ballasting procedure pertinent to grounding of the bottom base units during the mating and assembly phase.

FIG. 22 shows the use of a valve chamber extension trunk 102 to provide access by personnel into chamber 45 of a fully submerged base unit for purposes of ballasting and deballasting the base unit. The lower end of trunk 102 is connectible to the double-entry hatch assembly 103, previously described, which is installed to provide communication between each base unit moonpool passage and the adjacent valve and manifold chamber 45.

In the course of positioning fully assembled offshore structure 10 at its intended site of use, it is neccessary to fully or substantially fill the ballast spaces of all of the ballastable components of the structure to obtain the desired gravity load of the structure upon the sea floor. In these ballasting operations, valved connections 97, 98 to the ballast header manifolds in base units 12 will normally be below the waterline of the floating structure as it is positioned over the site of use. In some instances, full ballasting of the base units can be commenced merely by opening valve connections 98. In other instances, pertinent to some water depths, an upper tier of the structure must be at least partially ballasted to prevent the tier or tiers therebelow from sinking out from under or away from such upper tier. The point, an important one, is that careful attention must be given to ballasting sequences to assure that firm contact between adjacent tiers of structure 10 is maintained during the sinking operation. As soon as the assembled structure engages the sea floor, however, it becomes necessary to open the control valves provided in suction ducts 47 to the moonpool passages of base units 12. Thereafter, full ballasting of the components, including filling of manifold and valve chambers 45 and 48, is accomplished through the use of submersible pumps 100 connected to connections 97, 98 to the respective chambers so that all of the ballast spaces in the ballastable components of structure 10 can be fully filled.

Deballasting of components involves a reversal of pertinent ones of the procedures described above. The ballast spaces in the base units can be drained down to the level of the ocean by opening all of the manifold valves and connections 97, 98 in or associated with the respective manifold and valve chambers. Thereafter, deballasting can be completed by the use of submersible pumps 100 connected to the valve connections 97 and 98.

At at least one time during the useful life of each component, it will be necessary to position that component on the sea floor and then to refloat it from the sea floor. To facilitate refloating of a component from an at-rest position on a sea floor, each component is equipped with jetting means for supplying pressurized sea water to a multiplicity of points on its underside. The purpose of this jetting system is to provide a means for overcoming any suction force that will attempt to bind the component to the sea floor upon which it rests. Some soils, such as gravel or sand, may not require this mechanism. To refloat a component from at-rest position on a sea floor by the use of the jetting system, it will normally be necessary to fully deballast the component. The component can be "peeled" from the sea floor by operating the jetting mechanisms in sequence from one edge of the component toward the other. The jetting system includes a plurality of jet nozzles which open through the bottom of the component at selected locations over the area of the bottom. The jetting nozzles are separately operable via suitable valves which, preferably, are located either in the manifold and valve chamber 45 for the component, or which can be located in the pertinent ballast spaces.

Figure 23:
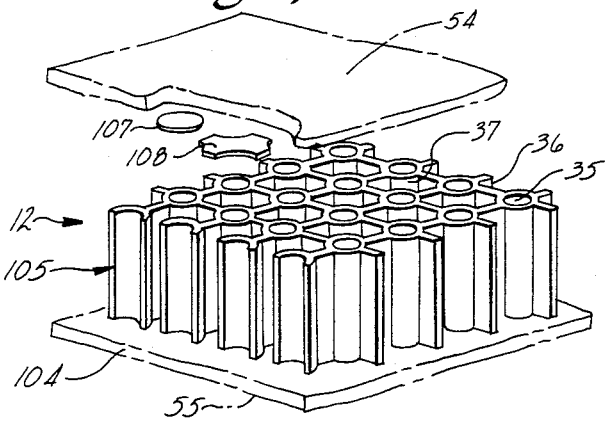
FIG. 23 is an exploded fragmentary perspective view of a portion of one of the base units of an offshore structure of this invention and shows the internal structure of the unit.
Figure 24:
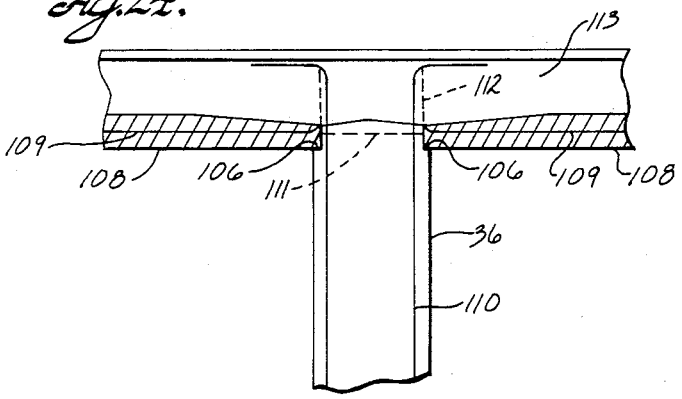
FIG. 24 is an enlarged fragmentary cross-sectional elevation view of an upper portion of a base unit.

Reinforced concrete barges having a honeycomb internal definition generally as illustrated in FIG. 4 have previously been constructed using poured-in-place fabrication techniques. Accordingly, the procedures and equipment useful in constructing the base units of an offshore structure according to this invention are generally known. FIGS. 23 and 24 illustrate the general sequence of construction of a reinforced concrete base unit module for structure 10.

As shown in FIG. 23, a reinforced concrete bottom slab 104 is first constructed in a suitable fabrication facility. Then, using either cast-in-place techniques or a fabrication procedure which involves precasting of individual cylindrical cells 35, a central honeycomb cell and intercell web arrangement 105 is erected on the bottom slab in such manner that the cells and intercell webs are integrally connected to the bottom slab, using known techniques. As shown in FIG. 24 with reference to an intercell web 36, the upper ends of all cells, whether they are the circular cells 35, cruciform cells 37, or the elongate cells defined between web walls 42, are all defined with recesses 106 around their upper perimeters. Each recess defines a receptacle for the placement across the upper end of each cell of a suitably configured precast, reinforced concrete closure or soffit, such as round soffits 107 for closing cells 35, and cruciform soffits 108 for closing the cruciform cells 37; similar precast plank-like rectangular soffits are provided for closing the cells defined between adjacent ones of shear walls 42 and the like. As prefabricated, the soffits all have reinforcing bars 109 which extend laterally from them. Similarly, before placement of the soffits in the corresponding receptacles, the vertical walls of the cells have reinforcing bars 110 which extend beyond the upper ends of the walls as cast to define recesses 106; such wall upper ends are represented by broken line 111 in FIG. 24. After placement of the soffits in recesses 106, the projecting ends of soffit reinforcing rods 109 are bent to assume a substantially vertical position, as shown at 112 in FIG. 24, and the projecting ends of wall reinforcing rods 110 are similarly bent over, all to serve as part of the reinforcing bar network for a top slab 113 which is then poured in place over the soffits and wall interim upper ends 111. This completes the principal casting operation for each base unit. The soffits function as forms for the pouring of top slab 113, but remain in the cast concrete construction as functional elements of the construction.

The ability of offshore structure 10 to maintain its desired position on sea floor 18 in the face of horizontally applied loads depends upon the sliding resistance presented by the subsea soil. This sliding resistance, in turn, depends on shearing of the soil at a point below that at which the structure engages the soil surface. To enhance the sliding resistance of the bottom base units along the sea floor, the bottom surfaces 54 of the base unit modules of structure 10, and particularly the bottom base units, can be configured as shown in FIGS. 25 and 26 to efficiently insure the coupling of the structure to the soil and obtain the full effective sliding resistance of the subsea soil.

Figure 25:
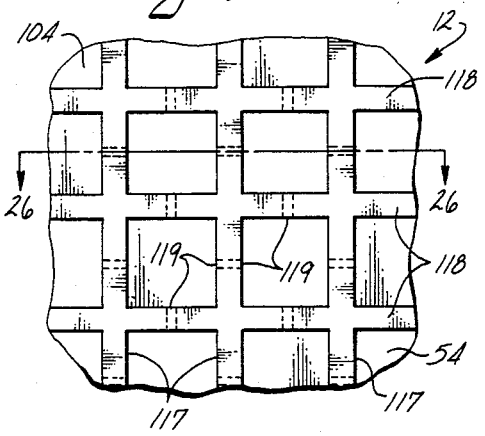
FIG. 25 is a fragmentary bottom plan view of a portion of the bottom surface of a lower base unit in the structure shown in FIG. 1.
Figure 26:
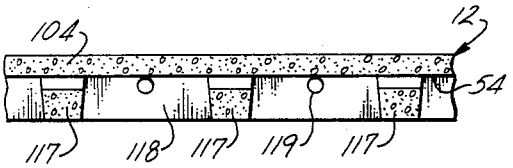
FIG. 26 is a cross-section view taken along line 26—26 in FIG. 25.

As shown in FIGS. 25 and 26, a plurality of tapered longitudinal 117 and transverse 118 ribs are cast integral with the bottom slab 104 of base unit 12 to project a selected distance below slab bottom surface 54. The ribs are spaced regularly, and preferably the spacing, say, 12 inches, between the longitudinal ribs corresponds to the spacing between the transverse ribs. Also, as shown in FIG. 26, it is preferred that all of the ribs extend a common distance, say, 3 inches, below slab bottom surface 54. In this way, a waffle-type grid of projecting ribs is defined in the bottom surface of the base unit to enable the base unit, when landed upon a subsea soil and fully ballasted, to firmly grip and co-act with the adjacent subsea soil. A passage 119 is defined along surface 54 through each rib between the intersections of the rib with the ribs running at right angles to it across the surface. Passages 119 permit water to flow along the interface between the base unit and the subsea soil in lateral directions out from under the base unit as the mass of the base unit and offshore structure 10 acts to express water from the soil. As water is expressed from the soil engaged by the landed and fully ballasted offshore structure, the soil increases its consolidation, becomes stronger, and so takes on further enhanced resistance to sliding of the structure.

Those familiar with the fabrication of large concrete structures will appreciate that it is difficult to produce a truly flat poured surface of large expanse. The upper and lower surfaces of base units 12, 14 and 15 are very large in area, and therefore it will be difficult to cause these surfaces to be formed in a perfectly planar manner unless costly fabrication techniques ar pursued. Therefore, it is likely, if not probable, that upon stacking the base units, opposing base unit surfaces 54 and 55 will not register perfectly with each other over the entire area of their interface 91.

To the extent that the surfaces defining horizontal interface 91 between stacked base units do not make perfect surface-to-surface contact, irregular contact between stacked components may produce unacceptable stress concentrations in the components. High stress concentrations in the concrete slabs, particularly near the middle of spans between the vertical cells, webs and walls, can result in cracks in the concrete; similar problems can occur in steel base units. Therefore, it is desirable to provide a means for accommodating and eliminating the effects of surface irregularities in the interfaces between stacked components. Such irregularities, undulations and deviations from perfect planarity in the opposed surfaces of stacked components is overcome and compensated by the use of a seating medium 120 in the interface between stacked components The seating medium preferably is disposed upon the upper surface 55 of each base unit which is to have another component placed upon it before the component is mated with the base unit in the performance of the procedures illustrated in FIGS. 10–19. The seating medium preferably is flowable or deformable under constant load, while being inelastic, i.e., nonresilient, under rapidly applied loads.

Figure 27:
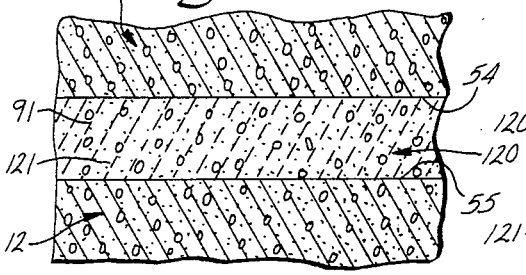
FIG. 27 is an enlarged fragmentary cross-sectional elevation view of another form of seating arrangement between stacked base units in an offshore structure of this invention.
Figure 28:
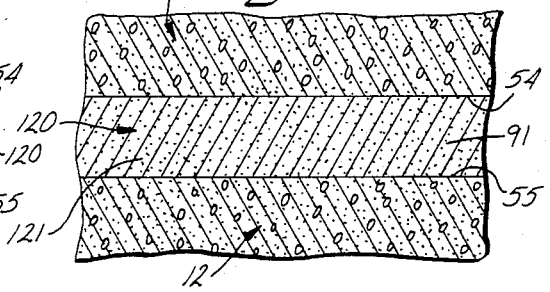
FIG. 28 is a view similar to that of FIG. 27 showing another seating arrangement between stacked base units.

FIG. 27, which is a cross-sectional elevation view of a portion of an interface 91 between stacked base units 12 and 14, illustrates the use of a layer of asphaltic concrete or macadam 121 to define seating medium 120. FIG. 28, which is generally similar to FIG. 27, shows the use of a layer of sand 122 to define seating medium 120. Pea gravel or the like may be used in lieu of sand. Where the seating medium is provided by a layer of granular material, such as sand or pea gravel, it may be useful to form the seating medium by use of a plurality of loosely woven, partially filled bags containing the selected granular material. Alternatively, it may be advantageous to use a cofferdam which extends upwardly a short selected distance from the lower component around the periphery of its upper surface to keep deposited granular material in place on the surface 55 until it has been forcefully engaged by the upper component and thereafter.

It is also within the scope of this invention that a mechanical cooperation between suitably configured projections and recesses, defined by the component surfaces forming an interface 91, may also be used to provide enhanced resistance to sliding between stacked components. For example, inasmuch as the horizontal relative positioning between stacked base units is rather precisely defined through the agency of shear pins 82 (see FIG. 20), the upper surface 55 of each base unit could be cast or fabricated to define projections which cooperate with a pattern of depending ribs (see FIGS. 25 and 26) cast integral with or fabricated on the bottom surface of the superadjacent base unit.

As indicated in FIG. 1, an offshore structure which has multiple tiers of base units is used in water depths selected so that mean ambient water level at the site of use is located substantially below the upper surfaces of the uppermost tier of base units. Accordingly, ice presents the principal and predominant lateral load on the structure in that portion of the height of the structure which is defined by the base units. Deck units 17 will not expericence significant lateral loads. Accordingly, the interface between deck units and base units will not experience high shear loads, and the use of interfitting projections between the deck units and the subadjacent base units is not required for purposes of shear resistance.

FIGS. 1, 2 and 3 illustrate the presence of armor belt 19 around the circumference of offshore structure 10 over that portion of the height of the structure which commences a short distance above its mean waterline and extends to a selected depth below the mean waterline. Also, as noted above, armor belt 19 is defined by a plurality of individual armor panels (see FIG. 2) which are installed in essentially end-to-end relation around the circumference of the pertinent tier of base units. It was noted above that armor panels 23 and 24 are of uniform height, say, 12 feet, but are provided in differing lengths, say, 28 and 14 feet, respectively. The armor panels are used to increase the inherent shell strength of the adjacent base units and to provide a replaceable abrasion surface for ice forces and motions. By providing local shell thickening only at the ice belt area, the total day weight of the base units is reduced and minimum draft of the base units is achievable. The armor panels are arranged, in cooperation with related features defined by the base units, to enable the armor panel belt to be installed at a number of elevations on the assembled offshore structure. The armor panels are readily replaceable in the event of severe ice abrasion or other damage.

The presently preferred armor panels are 14 inches thick as compared to the presently preferred 8 inch thickness of base unit walls 38, 39, 41 and 42. When present, the armor panels thus increase the local side wall thickness to 22 inches, or about 40 percent of the span of the adjacent base unit wall between shear walls 42. Each armor panel is attached by steel attachment devices which are arranged to accommodate and transfer to the adjacent base unit the shear and tension loads imposed on the individual armor panel due to ice loads applied laterally and vertically to the panel, due to ice freezing to the panel, due to ice forming in the spaces between the panels and the base units, and due to the weight of the panels.

Figure 29:
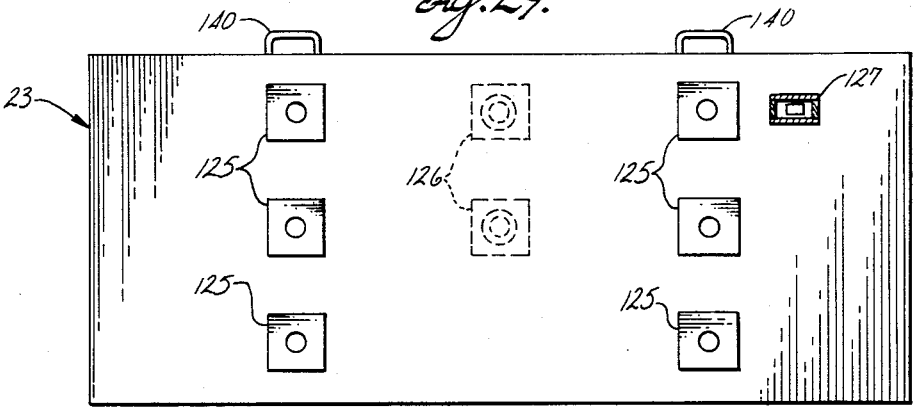
FIG. 29 is an elevation view of an ice armor panel for the offshore structure shown in FIG. 1.

A large armor panel 23 is shown in elevation in FIG. 29. Each armor panel, whether it is an AP28 unit or an AP14 unit (see FIG. 2), preferably is of reinforced concrete construction and carries, at suitably spaced locations, six tension bolt socket assemblies 125, two shear pin socket assemblies 126, and one torque pin socket assembly 127. In mounting an armor panel to structure 10, all tension bolt assemblies 125, one of the two shear pin socket assemblies, and the torque pin assembly 127 are used. The tension bolt assemblies (see FIG. 34) are provided for accommodating loads tending to move the mounted armor panel away from the adjacent base unit. The shear pin assemblies (see FIGS. 30 and 31) are used to carry all shear loads applied to the panel in the basic plane of the panel. The torque pin assembly (see FIGS. 32 and 33) is used to secure the panel from rotating about the shear pin and prevent shear in the tension bolts.

In each armor panel, tension bolt socket assemblies 125 are disposed in two vertical rows of three assemblies each. In each row, the socket assemblies are spaced on 4 foot centers. The spacing between the two rows of assemblies in each armor panel is an integral multiple of the spacing between adjacent shear walls 42 in each of the base units. The two shear pin socket assemblies 126 carried by each armor panel are also disposed vertically relative to each other and are spaced on 4 foot centers midway between the two rows of tension bolt socket assemblies. When the armor panel is mounted to a base unit, the shear pin socket assemblies lie adjacent the center of a base unit cell formed between two adjacent shear walls 42. The torque pin socket assembly 127 in each armor panel is located as far as practicable from the shear pin socket assemblies, preferably in an upper corner of the panel at such location in the panel that, when the panel is mounted to a base unit, socket assembly 127 is aligned substantially midway between two adjacent shear walls 42 in the base unit.

Figure 30:
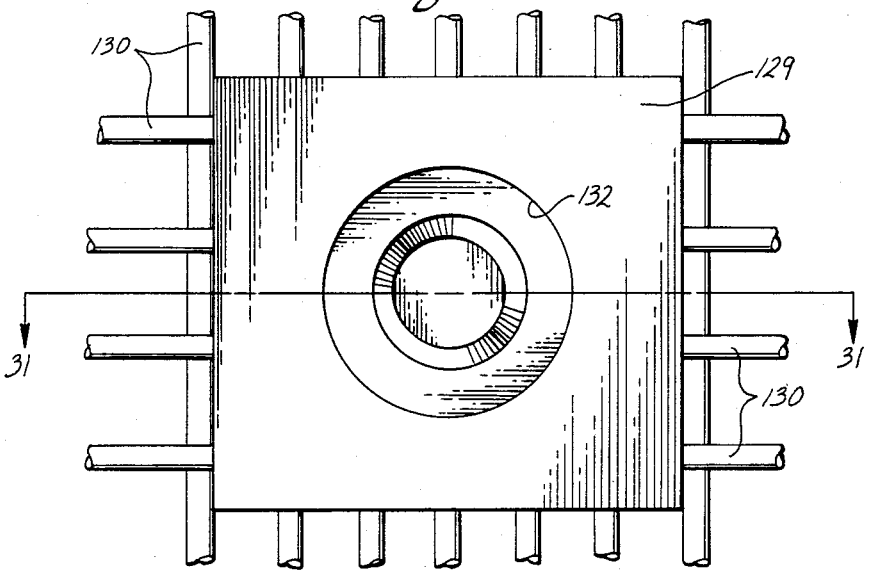
FIG. 30 is an enlarged elevation view of the shear pin and pin housing in the panel shown in FIG. 29.
Figure 31:
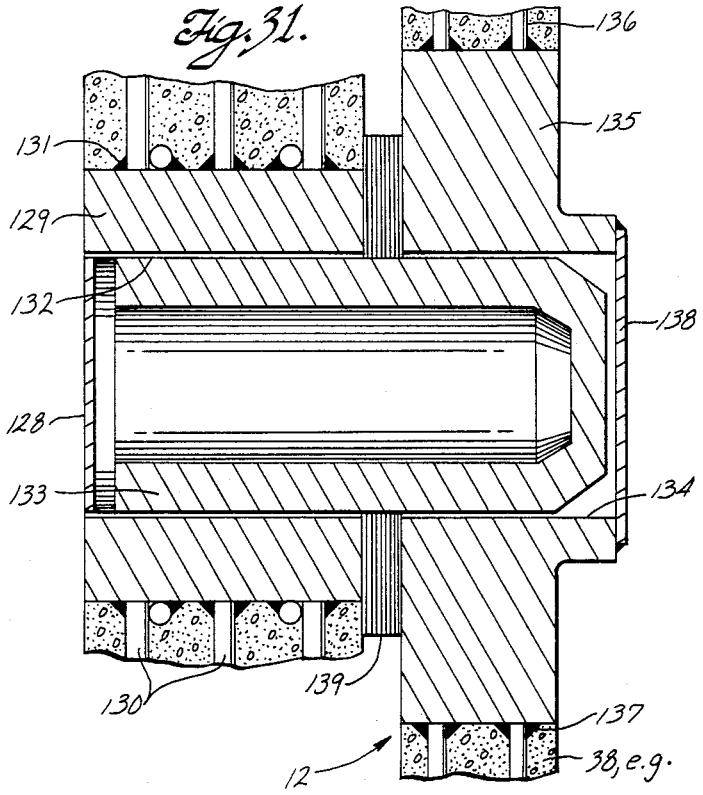
FIG. 31 is a cross-sectional view taken along line 31—31 in FIG. 30.

FIG. 30 is an elevation view, with parts broken away, of a shear pin socket assembly for an armor panel. In FIG. 30, a shear pin cover plate 128 (see FIG. 31) has been removed, and the concrete in the adjacent portions of the panel has been removed to illustrate that a panel shear pin socket member 129, preferably a massive casting, is securely connected to the steel reinforcing rods 130 within the panel, as by welds 131. Socket 129 has a thickness of 14 inches, i.e., a thickness equal to the thickness of the reinforced concrete which defines the principal portions of the armor panel. A circular bore 132 is formed centrally through socket 129 along an axis which is perpendicular to its front and rear surfaces. A preferably hollow and thick walled cylindrical shear pin 133 cooperates in bore 132 and with a bore 133 defined in a receiver member 134 which is a feature of the base unit. Receiver 135 is securely connected to the base unit reinforcing rods 136 by welds 137, as shown in FIG. 31. The inner end of receive bore 134 is closed by a closure plate 138. An annular rubber or neoprene cushion pad and gasket 139 is disposed between the outer surface of the base unit and the reverse side of the armor panel around the shear pin in the mounting of the panel to the base unit.

Two shear pin socket members 129 are located in each armor panel and are spaced vertically in the panel on 4 foot centers. The upper one of these members 130 is aligned with the upper ones of tension bolt socket assemblies 125 in the panel. In each base unit, however, shear pin socket members 135 are located in a vertical array on 8 foot centers. This difference between the vertical spacing of members 129 in each armor panel and the spacing between cooperating members 135 in the base units means that an armor panel can be secured to a base unit at any one of a number of discrete positions spaced 4 feet apart vertically along the base unit.

To mount an armor panel to structure 10, the panel is lowered, by use of lifting fixtures 140 carried on the upper edge of each panel, from the upper deck 31 of the structure to the desired vertical position adjacent the exterior of the structure where one of bores 132 in the panel is aligned with a bore 134 in the base unit hull. The shear pin 133 can be present in bore 132 to project from the rear of the panel. Thus, as the panel is lowered into position, the tapered inner end of the shear pin can slip readily and quickly into bore 134. The single shear pin which cooperates between each armor panel and the adjacent base unit carries all of the weight of the panel as well as loads which may be applied to the panel both vertically and horizontally by ice incident upon the panel.

Figure 34:
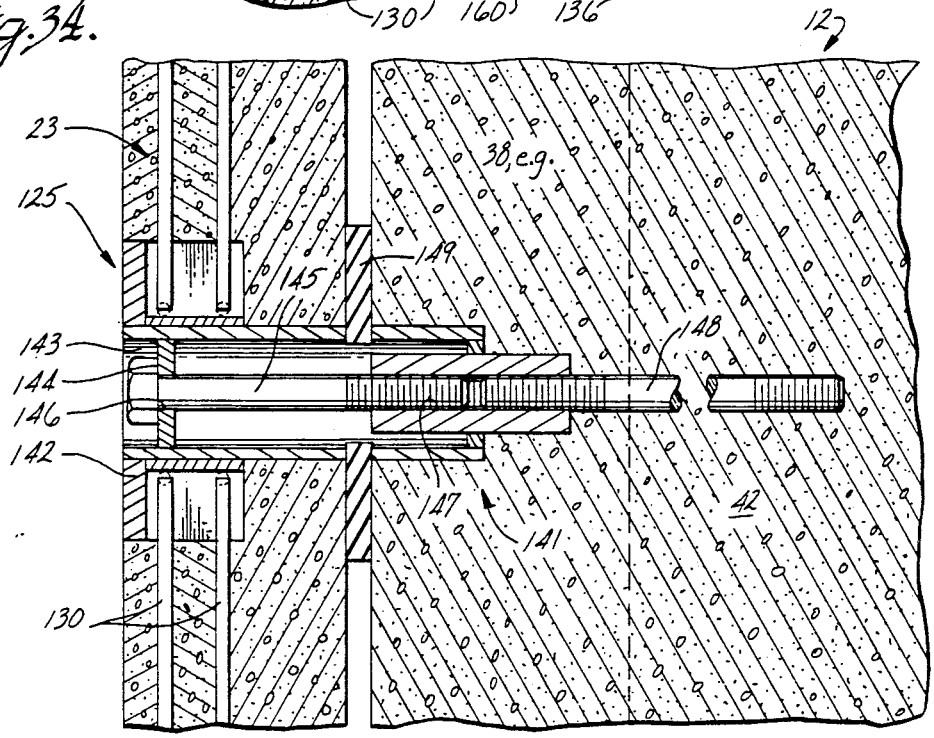
FIG. 34 is a fragmentary cross-sectional elevation view of an armor panel tension anchor assembly.

Once the weight of an armor panel has been transferred to an adjacent base unit via a shear pin 133, tension bolt socket assemblies 125 and their cooperating receiver assemblies 141 in the base unit are used, in combination with torque pin socket assembly 125, to secure the armor panel to the base unit. As shown in FIG. 34, the panel tension bolt socket assemblies 125 are metal constructions which may be of the built-up weldment type as shown in FIG. 34, or formed by suitable castings. Each assembly 125 includes a panel socket member 142 which is securely affixed to the reinforcing rods 130 of the panel prior to casting the concrete. The panel socket member extends between the forward and rear sides of the panel. The socket member defines a recess 143 having a bottom surface 144. Recess 143 is sized sufficiently to receive within the recess the entirety of the head of a tension bolt 145 when the shank of the bolt is passed through a bore 146 formed in surface 144. Bore 146 communicates to the rear surface of the panel. Each tension bolt 145 has a length which is substantially greater than the thickness of the armor panel. The threaded end of each tension bolt cooperates in a threaded socket 147 defined by the cooperating hull tension bolt receiver 141 which is carried in the adjacent base unit 12, for example, to be flush with the outer surface of base unit wall 38, for example. Receivers 141 are each carried at a predetermined location in the base unit determined with reference to the location in the base unit of the pattern and location of shear pin socket members 135 and with reference to the pattern and positioning of panel tension bolt socket assemblies 125 in the several armor panels. The rear end of receiver 141 is securely affixed, as by welding or threading, to one end of an elongate embedment rod 148. The several receiver assemblies are carried in the walls of the base units in line with selected ones of shear walls 42. Accordingly, embedment rod 148 extends a substantial distance from its cooperating receiver 141 into the concrete which defines the pertinent base unit shear wall.

Inasmuch as it is known in advance of placement of offshore structure 10 at the intended site of use approximately where the mean waterline of the installed structure will lie vertically on the structure, it is possible to ascertain before final positioning of the offshore structure which of the several receiver assemblies 141 will be used for the mounting of armor panel belt 19 to the pertinent base units. Once it is known which receivers 141 will be used in mounting the armor panel belt to structure 10, an annular resilient cushion pad 149 formed of, say, neoprene or rubber, is bonded to the outer surface of the base unit sustantially coaxially of the designated receivers. Preferably cushion pads 149, which have the same thickness as cushion pads 139 used with the shear pin assemblies, are applied to the exterior surfaces of the pertinent base units at that point in the sequence of operations illustrated in FIGS. 10–19 when the pertinent base units have a draft adequate to provide ready access to the designated receivers.

Figure 32:
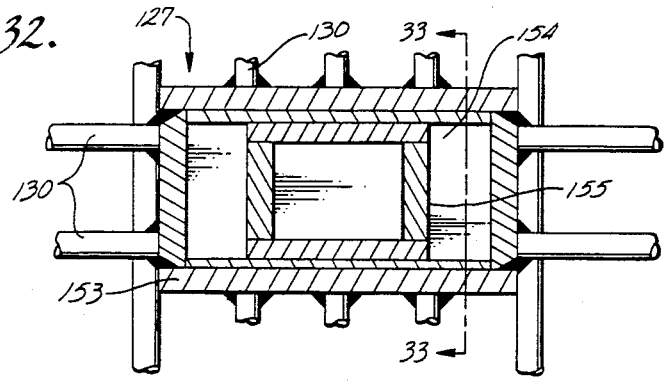
FIG. 32 is a cross-sectional elevation view of the torque pin and pin housing in the panel in FIG. 29.
Figure 33:
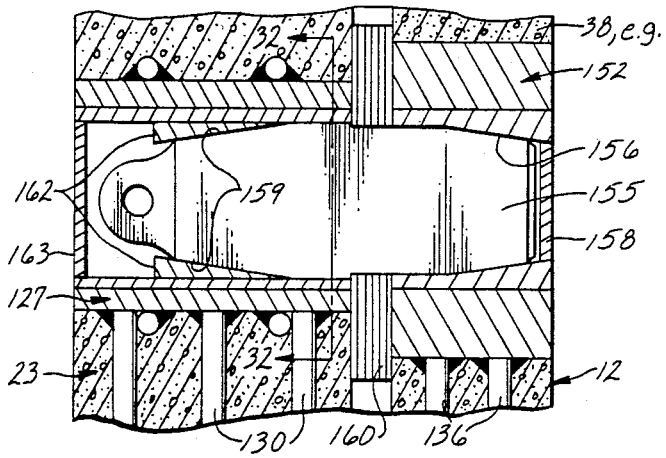
FIG. 33 is a cross-section view taken along line 33—33 in FIG. 32.

The details of a torque pin socket assembly 127 for an armor panel 23, 24 are shown in FIGS. 32 and 33; FIG. 33 also shows details of one of the several hull torque pin receivers 152 which are carried by each base unit in association with each group of possible positions of an armor panel on its outer walls. As shown in FIGS. 32 and 33, each panel torque pin socket 127 is comprised of a heavy metallic socket member 153 which can be either a weldment or a casting, which is securely affixed to the reinforcing rods 130 of the panel, and which extends from front to back through the armor panel at a predetermined location in the panel. Socket member 153 defines a passage 154 which is open entirely through the panel. The passage is non-round, preferably rectangular, in cross-section and is wider than it is high (see FIG. 32). An elongate torque pin 155 which preferably is a built-up construction of non-round, preferably rectangular, cross-section, cooperates in passage 154 and in a tapered recess 156 formed in hull receiver member 152. Recess 156 is also rectangular in configuration, similar to the configuration of recess 154. Recess 156 is tapered (as shown in FIG. 33) in that the rear portions of its top and bottom surfaces converge linearly toward each other. The rear end of recess 156 is closed by a suitable closure plate 158. Receiver 152 is a relatively massive member wnich is securely affixed to the reinforcing rods 136 disposed in base unit wall 38, for example, so that any loads applied to receiver 152 are safely borne and transferred to the overall structure of base unit 12.

Shear pin 155 has vertical side walls and top and bottom walls which are parallel to each other centrally of the length of the shear pin. Adjacent the rear end of the shear pin, i.e., the end of the shear pin which is engageable in recess 156, the top and bottom surfaces of the pin coverage linearly at the same slope as defined by the taper of the top and bottom walls of recess 156 toward its rear end. Also, the top and bottom surfaces of the pin slope toward each other, as at 159, at the forward portion of the pin.

Preferably the torque pin for each armor panel is fully engaged in its seating passage 154 and recess 156 after tension bolts 145 have been engaged with their receivers 141 but before the tension bolts are fully tightened, thereby enabling the torque pin to be installed while limited angular movement of the armor panel about its shear pin 133 is still possible. Installation of the torque pin 155 involves insertion of the torque pin into passage 154 and into seated engagement with recess 156 with which socket assembly 127 is substantially aligned following engagement of the panel shear pin in its receiver. Such insertion of the torque pin includes passage of the pin through a resilient cushion pad 160 which is similar to cushion pads 139 and 149 and which preferably is prefitted to the pertinent torque pin receiver at the same time as cushion pads 139 and 149 are prefitted to the corresponding base unit. Following seating of the inner end of the torque pin in recess 156, a pair of wedges 162 are driven into engagement between the tapered portions 159 of the pin top walls and the adjacent walls of passage 154. The wedges are tack-welded in place to cause the torque pin to be securely and snugly engaged within socket assembly 127. The portions of passage 154 and recess 156 which are not occupied by torque pin 155 are packed with a suitable grease or the like. The open forward end of passage 154 is then secured by a suitable closure 163 so that the forward surface of panel 23 is smooth across the location of the shear pin socket assembly. Thereafter, the several tension bolts 145 for the armor panel are tightened to securely clamp the armor panel to the adjacent base unit in the precise position defined by the combined effect of shear pin 133 and torque pin 155. The panel then cannot move linearly parallel to the adjacent base unit wall surface by reason of the effect of the shear pin, and the panel cannot move angularly relative to the adjacent base unit because of the effect of the torque pin.

It was noted above that each armor panel is mountable to the adjacent base unit at a number of positions which are spaced vertically 4 feet apart along the base unit. In order that such positional variation can be achieved through the use of armor panels which carry only one torque pin socket assembly 127, it will be apparent that each base unit must include a suitable number of torque pin receivers 152 at each staion on the perimeter of the base unit where an armor panel can be mounted. The torque pin receivers at each station are spaced vertically on 4 foot centers in the pertinent base units.

Figure 35:
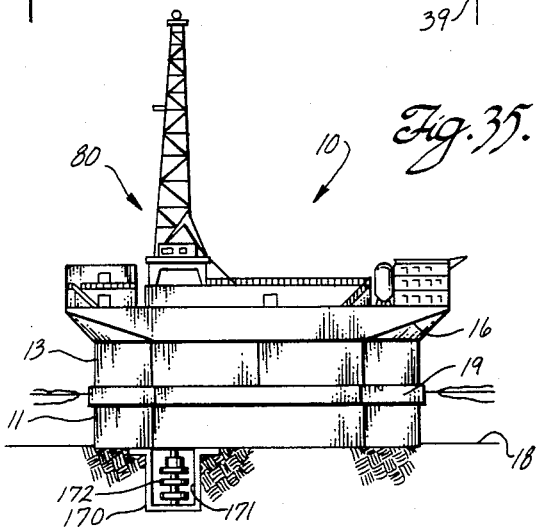
FIG. 35 is an elevation view, partially in cross-section, which shows an offshore structure generally like that shown in FIG. 1 used in combination with a sea floor cellar for wellhead equipment.

FIG. 35 shows that there may be some applications and uses of an offshore structure according to this invention in which it is desirable or required that the structure be used in combination with some other arrangement or device installed at sea floor 18 at the intended site of use of the offshore structure before the final placement of the structure at the site. This is particularly true in the instance of oil and gas well drilling operations, or in the production of oil and gas from completed production wells. In the illustrative instance of exploratory well drilling operations, FIG. 35 shows offshore structure 10 outfitted as a drilling facility in use over a subsea cellar structure 170 which is adequately sized to define one or more upwardly open chambers 171. The chambers are provided for receiving blowout preventers 172 and other associated wellhead drilling equipment below mudline, i.e., the upper surface of subsea soil layer 18. Offshore structure 10 is positioned at the site of use so that its vertical moonpool passages align with the cellar structure. In the event that structure 10 should ever be moved laterally along the sea floor in response to displacing forces, the production equipment located in cellar chambers 171 can be undisturbed and undamaged.

Figure 36:
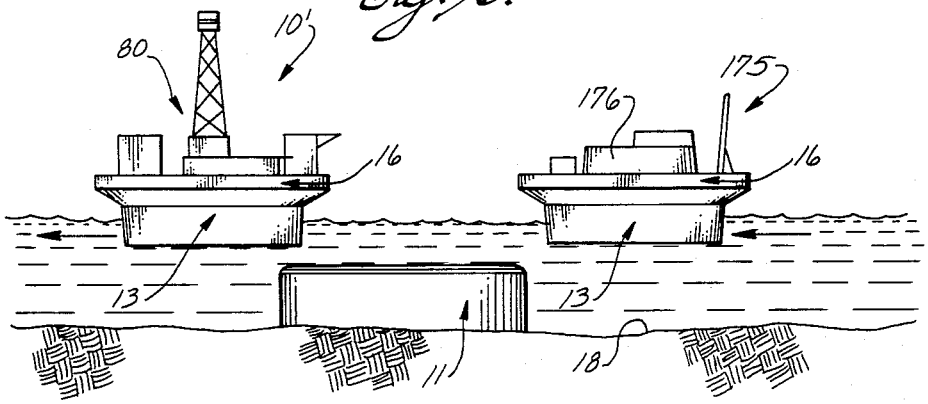
FIG. 36 is an elevation view illustrating the use of a common lower portion of a structure with different upper portions at a site to provide, in sequence, different offshore platforms for different purposes.

FIG. 36 illustrates the versatility afforded to various Arctic operations by use of offshore structures according to this invention. FIG. 36 illustrates that the lower tier of a production drilling offshore structure 10' according to the foregoing description, and defined of base units of suitable relative heights, can be left in place on sea floor 18 at the completion of production as the central tier of structure 10' and all components and equipment carried by the central tier are moved away to be replaced by a central and upper tier assembly of a second offshore structure 175 outfitted with an operations facility 176 adapted for production and processing of oil and gas from wells completed by use of structure 10'. Offshore structure 175 is a subcombination of the modular components of an offshore structure according to this invention (see FIG. 2) which can be moved into alignment with and registry with lower tier 11 within hours following the removal of the upper portions of structure 10' from the location.

Thus, it is seen that this invention makes possible the rapid, efficient and effective installation of a production facility at a desired offshore site in the Arctic promptly upon completion of the wells to be produced. Removal of the central and upper portions of structure 10' from lower tier 11 (which remains in place in a fully ballasted condition or sea floor 18) can be accomplished by withdrawing vertical shear pins 82 from their receiving sockets 83 in the base units comprising lower tier 11, and by at least partially deballasting the ballast spaces in the base units and deck barges defining the upper portions of structure 10'. Offshore structure 175 is quickly, efficiently and safely matable with the base units of tier 11 by use of the procedures described above and illustrated in FIGS. 17, 18 and 19, for example. Production drilling platform 10', following removal from its site of use as illustrated in FIG. 36, can be mated with a new or different offshore structure lower tier (composed of suitably sized bricks, BB44, BB32, BB17 or the like) for installation at a new site of use by application of the procedures illustrated in FIGS. 15–19, for example.

Figure 37:
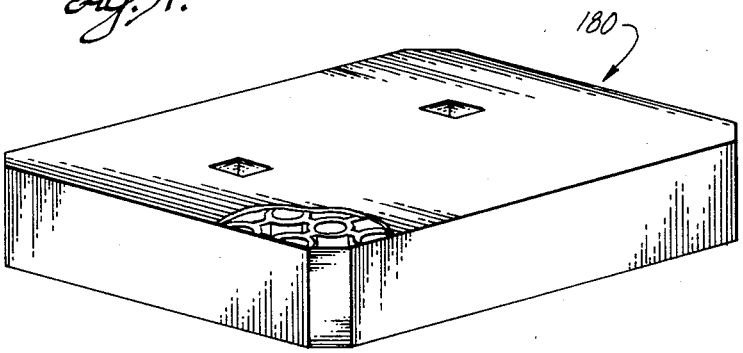
FIG. 37 is a perspective view, partially in section, showing a base unit useful to define the entirety of a tier in an offshore structure of this invention.

It is within the scope of this invention that an offshore structure according to this invention can be defined by a single honeycomb reinforced concrete brick-like base unit of suitable dimensions, if desired. FIG. 37 illustrates a very large base unit 180 suitable for defining a single brick tier of an offshore structure. Base unit 180 is, in effect, the combination of the two base units 12, for example, provided as a single integral unit rather than a mated pair of smaller units. The factors which determine the practical efficacy of the use of base unit 180 include the availability of construction facilities of suitable size and capacity, the location of such construction facilities relative to the intended site of use of base unit 180, and factors pertinent to the movement of such a large base unit from the construction site to its site of use, among other things.

The honeycomb compartmentalization and reinforced concrete construction of the preferred base units of an offshore structure as described above provide definite and attractive advantages over other structural framing systems and construction approaches. The concrete base units are economical and can be constructed with ease. They provide superior structural strength and rigidity. The honeycomb compartmentalization of the base units affords easy variation in compartmentation within the base units. The high compartmentalization of the base units provides excellent control over the submergence procedures which have been described above. Reinforced concrete structures are very resistant to damage and are quite advantageous in terms of pollution prevention. Concrete is corrosion resistant, spark resistant and fireproof; the reinforced concrete base units provide excellent safety considerations, and they have enhanced reliability and maintainability characteristics and are readily field repairable. Moreover, an offshore structure according to this invention has additional advantages. The use of modularization makes it possible to construct the individual components of the structure concurrently in different construction facilities which may be located in diverse locations worldwide; individual components of the structure can be built in those facilities where greatest expertise is available, or the greatest economies can be realized. The structure has a low life-cycle cost applicable to a long operational period. The modular components can be fabricated in industrialized areas at existing sites and towed to the Arctic site of use. No dredging, or only minimal dredging is required at the site of use for installation or relocation. The replaceable armor panels which have been described are added at the ice line experienced by a particular structure to protect the base structure without suffering a weight penalty to the entire side wall areas of the structure. An offshore structure according to this invention uses sea water ballast and so avoids the use of special dredging and transfer of other ballast materials or the use of special fluids. The structure can be refloated, moved and re-used over and over. Sound transmission through concrete is low and so marine life is virtually unaffected by the use of an offshore structure according to this invention. In extreme circumstances during Arctic use of the offshore structure, conventional ice defense procedures can be practiced to keep the structure from experiencing environmental forces in excess of reasonable design limits.

It is a feature of this invention that the various modular components, provided by the kit of components illustrated schematically in FIG. 2, can be selected and assembled to provide a wide range of specific offshore structure configurations suited to a wide range of usage condititons and locations. For example, an offshore structure comprised of BB32 and DSB or DSBR components is usable in water depths in the range of from 18–30 feet. An offshore structure composed of BB44 and DSB or DSBR modules is usable in water depths in the range of from 24–42 feet. An offshore structure, such as structure 10 shown in the accompanying drawings, composed of modules BB44, BB32 and DSB, DSBR, IDU or equivalent modules can be used in water depths ranging from 37–60 feet. Other offshore structures usable in different water depths can be assembled and defined by use of other combinations of the components shown in FIG. 2 or other modules consistent with the foregoing descriptions.

The modular components for an offshore structure according to this invention are provided pursuant to an integrated approach which has carefully considered and addressed pertinent environmental, design and logistics critieria. For example, the presently preferred offshore structure 10 which has been described above is suited for use in Arctic applications where the following environmental criteria are applicable.

TABLE I

| ENVIRONMENTAL CRITERIA | |
|---|---|
| Air Temperature | 60° F. to +70° F. |
| Wind Speed | 70 Knots (Survival) |
| Significant Wave Height | 14 Feet (10 Year Storm) |
| Water Depth | 18 to 52 Feet |
| Current | 3 to 4 Knots (10 Year Storm) |
| Tide | 6 to 12 Inches |
| Ice Thickness | 0 to 6.5 Feet |
| Movement Velocity | |
| Outside Barrier Islands | 50 Feet/Hour |
| Inside Barrier Islands | 8.4 Feet/Hour |
| Ice Load | |
| Global Crushing | |
| Inside Barrier Islands | 240 Kips/Foot |
| Outside Barrier Islands | 460 Kips/Foot |

TABLE I-continued

| ENVIRONMENTAL CRITERIA | |
|---|---|
| Local Impact | 600 Psi (over a 5 × 28 Foot Area) |
| Breakout Shear | 50 Psi |
| Breakout Tension | 50 Psi |
| Ice Defense | None |
| Soil Characteristics | Over-Consolidated Clayey Silts |
| Allowable Soil Bearing | 6.0 Kips/Ft$^2$ |

Such an offshore structure is consistent with and respects the following design criteria.

TABLE II

| DESIGN CRITERIA | |
|---|---|
| External Hydrostatic Head | 64 Feet-Bottom BB (At Installation) |
| Minimum Safety Factors: | |
| Sliding, Overall | 1.5 |
| Ice Load | 1.3 |
| Hydrostatic Load | 1.5 |
| Soil Bearing | 2.5 |
| Classification | ABS/USGS |

Also, the following logistics criteria are pertinent to offshore structure 10.

TABLE III

| LOGISTICS CRITERIA (4 MONTH SUPPLY) | |
|---|---|
| Drill Mud & Chemicals (Dry) | 45,000 Sacks |
| Drill Mud Active (Liquid) | 1,000 Barrels |
| Drill Mud Reserve (Liquid) | 4,000 Barrels |
| Cement (Bulk) | 10,000 Cubic Feet |
| Drill Water Usage | 375 Barrels per Day |
| Drill Water Storage with Desalination | 1,000 Barrels |
| Drill Water Storage without Desalination | 45,000 Barrels |
| Fuel Usage | 5,000 Gallons per Day |
| Fuel Oil Storage | 16,000 Barrels |
| Cuttings Storage | 3,000 Barrels |
| Casing Storage | Sufficient for One Production Well |

The features of modularity and stackability of the components of an offshore structure according to this invention are not limited to the use of structure components defined only of reinforced concrete. The use of reinforced concrete base units in the practice of this invention is presently preferred and is regarded as the best mode of practicing the invention, and the preceding description has addressed the use of reinforced concrete base units for these reasons. However, the benefits of modularity and stackability of components of an offshore structure can also be realized through the use of base units constructed of steel, preferably steel base units having geometries, configurations, dimensions, and external features the same as or compatible with the same characteristics of the concrete base units described above. Steel and concrete base units can be intermixed and interengaged as desired.

Base units fabricated entirely of steel can be lighter than equivalent base units fabricated of reinforced concrete, thus providing base units having reduced unballasted draft. In some sites of use, minimum draft properties may be important.

In the context of base units fabricated of steel, it is presently preferred to define the base units as modifications of the tank spaces of tanker ships or other very large cargo carriers. There is presently a large worldwide supply of tankers which have been or are being retired from service, and which will be broken up for scrap unless other uses for them, or for portions of them, can be found. The use of a tanker midbody, with modifications, to define a base unit for an offshore structure of this invention can have the benefit of short construction time to better meet an urgent need for the benefits of this invention.

Thus, the scope of this invention can encompass an offshore structure composed of plural tiers of modular structural components in which all base unit components are fabricated of reinforced concrete, or in which all base unit components are fabricated of steel, or in which the base units are composed of a mix of some reinforced concrete units and some steel units.

The foregoing descriptions, and the accompanying drawings with reference to which such descriptions have been made, set forth presently preferred and other exemplary embodiments of this invention. Neither the foregoing description nor the accompanying drawings are intended to constitute, nor should they be interpreted to be an exhaustive catalog of all forms of the structures and procedures which may be adopted as embodiments and manifestations of this invention. Rather, the preceding description and the accompanying drawings have been presented illustratively, by way of example, and in furtherance of an exposition of the presently known best mode for practicing the structural and procedural aspects of this invention. Variations in the structures and procedures described may be practiced without departing from the true scope and content of this invention. Accordingly, the preceding descriptions and accompanying illustrations shall not be interpreted to restrict the following claims to less than their fair scope.

What is claimed is:

1. An arctic offshore structure of the gravity type movable buoyantly to and from a position over a site of use located on a sea floor under waters in a selected range of depths, the structure when installed at the site extending from a lower end substantially at the sea floor through and above the water surface to an upper operations end of the structure which is adapted to carry a selected operations facility, the structure through a portion thereof between (a) a first location adjacent its lower end and below the water surface and (b) a second location in the structure a substantial distance above the water surface having substantially vertical and substantially flat outer walls, the structure in said portion being comprised of at least one unitary base unit, each base unit being floatable, each base unit being reversibly ballastable adequately to impart to the structure sufficient negative buoyancy, in combination with the nature of the sea floor, to maintain a desired position at the site under environmental forces applied horizontally to the structure.

2. Apparatus according to claim 1 wherein at least one of the base units is fabricated of reinforced concrete arranged within the unit to define a plurality of vertical cells and intercell webs.

3. Apparatus according to claim 2 wherein each reinforced concrete base unit has top and bottom slabs and the cells and webs extend between the slabs, a portion of the interior of each such base unit being defined by substantially circular vertical cells located on centers spaced farther than the cell diameters and interconnected by the webs, other portions of the interior of each such base unit adjacent at least some of the base unit outer walls being defined by vertical inner walls disposed substantially normal to and intersecting the immediately adjacent outer walls.

4. Apparatus according to claim 3 wherein the inner walls extend frowm the outer walls to vertical bulkhead walls which extend between the top and bottom slabs.

5. Apparatus according to claim 1 including a cavity in each base unit, a duct communicating from the cavity through an outer wall of the base unit, and ballast means operable for ballasting and deballasting the base unit from and to the cavity.

6. Apparatus according to claim 6 wherein the interior of each base unit is subdivided to define a plurality of ballast spaces, and the ballast means includes a chamber in the base unit adjacent the cavity, duct means communicating each ballast space to the cavity via the chamber, and valves in the duct means operable in the chamber for establishing and regulating communication from each ballast space to the cavity.

7. Apparatus according to claim 6 including vent means communicable from the upper extent of each ballast space to the cavity.

8. Apparatus according to claim 6 wherein each chamber includes a ballast manifold having a valved connection to each ballast space in the base unit, and plural valved connections from the manifold to the exterior of the cavity.

9. Apparatus according to claim 8 wherein the cavity in at least one base unit opens through the top and bottom surfaces of the base unit.

10. Apparatus according to claim 6 including means for heating the ballast spaces in each base unit.

11. Apparatus according to claim 1 wherein the interior of each base unit is subdivided into a plurality of water ballast spaces, and means for heating water in the ballast spaces.

12. Apparatus according to claim 1 wherein the structure is composed of plural tiers of modular components of the structure including at least one base unit tier in a lower portion of the structure each defined by at least one base unit and an upper tier defined by at least one ballastable barge unit.

13. Apparatus according to claim 12 wherein the base unit tiers have substantially equal dimensions of length and width.

14. Apparatus according to claim 13 wherein each base unit tier is composed of a pair of base units of equal height and length.

15. Apparatus according to claim 14 wherein the upper tier is composed of a pair of barge units.

16. Apparatus according to claim 15 wherein each barge unit is defined for carrying a base unit.

17. Apparatus according to claim 16 wherein each barge unit is operable as a submersible barge.

18. Apparatus according to claim 12 wherein each tier of the structure is composed of a pair of similar modular components each having a length dimension at least about twice a width dimension thereof, the components in each tier being disposed with their length dimensions transverse to the length dimension of the components in each adjacent tier.

19. Apparatus according to claim 1 including an environmental armor belt of selected height carried by the structure about its circumference in said portion of the structure.

20. Apparatus according to claim 19 wherein the armor belt is comprised of a plurality of discrete armor panels each of the selected height.

21. Apparatus according to claim 20 wherein the armor panels are fabricated of reinforced concrete.

22. Apparatus according to claim 20 including panel connection means releasably connectible between each panel and the adjacent base unit for securely connecting the panel to the base unit.

23. Apparatus according to claim 22 wherein the panel connection means includes plural connection features carried by each panel in a selected pattern, and a greater number of cooperating connection features carried by the adjacent base unit in respect to each panel in an arrangement corresponding to the selected pattern and to vertical extensions thereof, whereby each panel is connectible to the adjacent base unit at each of plural vertically-spaced discrete positions on the base unit.

24. Apparatus according to claim 22 wherein, for each panel, the connection means include first connection means for carrying shear loads between the panel and the adjacent base unit, second connection means operative for carrying torque loads between the panel and the base unit, and third connection means for carrying loads urging the panel away from the base unit.

25. Apparatus according to claim 24 wherein each connection means includes a resilient member disposed between the panel and the base unit.

26. Apparatus according to claim 20 wherein each armor panel has a thickness greater than the thickness of the adjacent outer wall of the adjacent base unit.

27. Apparatus according to claim 1 wherein the base unit defining the lower end of the structure has a bottom surface from which extend for a selected distance a plurality of ribs, the ribs extending in orthogonal directions across the bottom surface and intersecting each other.

28. Apparatus according to claim 27 including a passage through each rib parallel to and adjacent the base unit bottom surface between adjacent intersections of the rib with other ribs.

29. Apparatus according to claim 1 including means carried by each base unit defining the lower end of the structure operable for forcing water under pressure through a bottom surface of the base unit at selected locations on the bottom surface.

30. A mobile gravity structure for offshore marine use in water having a depth within a selected range of depths, the structure comprising a plurality of tiers of prefabricated modular structural units cooperatively structurally interrelated and equipped to cause the structure to have a desired geometry and desired suitability for an intended use in a selected environment, the units including at least one base unit of selected height having top and bottom surfaces and substantially vertical outer walls, means cooperable between units for securing the units from relative movement in response to environmental forces, each unit having a buoyant state, ballast means operable for controllably ballasting each unit between its buoyant state and a state of reduced buoyancy which for the base units is a nonbuoyant state, the several units being assemblable into the structure substantially only by selective ballasting, deballasting and mating of the units in a predetermined sequence, the several units when assembled being floatable as an entity into and out of partially submerged forceful engagement with a sea floor in waters within the selected range of depths.

31. Apparatus according to claim 30 wherein each tier is composed of at least two modular structural units, the units in each tier having a common height, and means for connecting together the units in each tier.

32. Apparatus according to claim 31 wherein each modular structural unit has a length substantially greater than a width thereof, the units in each tier being matable with units in the next lower tier of the structure with the lengths thereof oriented transversely of the lengths of the units in the next lower tier.

33. Apparatus according to claim 30 wherein the portion of the structure defined by the base units includes an upper tier and at least one additional tier therebelow, the structure in said portion having substantially flat vertical walls.

34. Apparatus according to claim 33 wherein the structure in said portion has essentially equal dimensions of width and length.

35. Apparatus according to claim 33 wherein the structure in said portion has a geometry substantially that of a square pillar having chamfered corners.

36. Apparatus according to claim 30 wherein the structure, when disposed in partially submerged engagement with a sea floor, has a waterline at a tier defined by at least one of the base units, and armor means attachable to the waterline tier for defining an armor belt around the structure at the waterline.

37. Apparatus according to claim 36 wherein the armor means comprises a plurality of reinforced concrete armor panels individually attachable to the structure waterline tier, the armor panels each having a thickness greater than the thickness of the base unit outer walls.

38. Apparatus according to claim 30 further comprising a unitary base assembly engageable directly with a sea floor in a fully submerged state, the base assembly having an upper end adapted to receive and support the mobile gravity structure via the lower tier thereof.

39. Apparatus according to claim 38 wherein the mobile gravity structure at the lower tier thereof has selected dimensions of length and width, and the base assembly has substantially greater dimensions of length and width.

40. Apparatus according to claim 39 wherein the base assembly has side walls which slope outwardly and downwardly from the upper end of the assembly.

41. Apparatus according to claim 30 wherein the modular structural units of the structure are cooperatively configured and arranged to define, upon assembly thereof into the structure, an open passage vertically through the structure at a selected location in the structure inwardly of the base unit outer walls.

42. A set of modular structural units of coordinated and cooperatively related configuration and arrangement assemblable in selected numbers and arrangements to define one of a series of possible mobile gravity structures for marine use in a selected range of water depths within a wider range of water depths pertinent to the series, the set comprising at least one of each of the following modular structural units:

a. a deck unit of selected height, length and width fabricated of steel and arranged to define an upper deck of a mobile gravity structure, b. a first base unit of selected height, length and width and having vertical essentially flat outer walls extending between top and bottom surfaces, and c. a second base unit of selected height different from the height of the first base unit and having length and width essentially equal to that of the first base unit and vertical essentially flat outer walls extending between top and bottom surfaces, each modular structural unit being floatable and including ballast means operable for controllably ballasting and deballasting the unit between positively and substantial negatively buoyant states.

43. A set of modular structural units of coordinated and cooperatively related configuration and arrangement assemblable in selected numbers and arrangements to define one of a series of possible mobile gravity structures for marine use in a selected range of water depths within a wider range of water depths pertinent to the series, the set comprising at least the following modular groups of structural units:

(a) two substantially similar deck units of selected height, length and width fabricated of steel and arranged to define an upper deck of a mobile gravity structure, (b) first and second similar base units of selected height, length and width and having vertical essentially flat outer walls extending between top and bottom surfaces, and (c) third and fourth similar base units of selected height, which may differ from the height of the first and second base units, and having length and width essentially equal to that of the first and second base units and vertical essentially flat outer walls extending between top and bottom surfaces, each modular structural unit being floatable and including ballast means operable for controllably ballasting and deballasting the unit between positively and substantial negatively buoyant states, and base units having lengths greater than their widths, and each deck unit having a bottom surface having length and width dimensions essentially equal respectively to the base unit lengths and widths, and connection means releasably cooperable between the first and second base units, between the third and fourth base units, and between the deck units for connecting such units in side-by-side relation.

44. Apparatus according to claim 43 wherein each deck unit is operable as a submersible barge and, in the positively buoyant state, is capable of supporting the larger of the first and second base units thereon.

45. Apparatus according to claim 43 wherein the modular structural units are defined to be stackable in tiers composed of the deck units as an upper tier, and at least two base units of equal height as an additional tier with the lengths of the units in each tier disposed transversely of the lengths of the units in the tier next therebelow, and means cooperable between units in adjacent tiers for securing the units from lateral relative movement.

46. Apparatus according to claim 45 wherein the units of the set are cooperatively configured to define, upon stacking thereof in predetermined positions and relations, at least one passage vertically through the units.

47. Apparatus according to claim 42 wherein the modular structural units are defined to be stackable and are cooperatively configured to define, upon stacking thereof in predetermined positions and relations, at least one passage vertically through the units.

48. Apparatus according to claim 42 wherein the set further comprises a plurality of armor panels of selected thickness greater than the thickness of the outer walls of either base unit and of selected height, and mounting means defined by and cooperable between the base units and the panels for mounting the panels to the outer walls of a base unit as a belt substantially around the base unit.

49. Apparatus according to claim 48 wherein the mounting means are defined for mounting of the panels to a base unit at any one of several discrete locations vertically on the base unit outer walls.

50. Apparatus according to claim 42 wherein the set further comprises a submergible base assembly fabricated of steel and configured to directly engage a sea floor of predetermined nature and to provide a substantially level top surface with which a base unit is engageable for support by the base assembly.

51. Apparatus according to claim 48 wherein each armor panel is fabricated principally of reinforced concrete.

52. Apparatus according to claim 42 in which at least one of the base units is fabricated of reinforced concrete arranged within the unit to define a plurality of vertical cells and intercell webs.

53. An armor panel for use with an offshore structure supported on a sea floor and extending through the surface of water on which ice may float, the structure having a flat vertical outer wall to which the panel is mountable at a location on the offshore structure which extends from substantially below to above the water surface, the panel comprising a substantially uniformly thick constructed member of selected height and width for covering a substantial area of the outer wall of the offshore structure, the panel member having front and rear surfaces and a thickness therebetween adequate in combination with the construction of the panel member for distributing over said area of the offshore structure outer wall via the panel member a load applied laterally to the offshore structure as by an ice floe contacting the panel member, and mounting means carried by the panel operable for mounting the panel to the structure outer wall in cooperation with cooperating means carried by the structure, the panel mounting means including a first socket in the panel at a selected location in the height of the panel substantially centrally of the width thereof and open through the panel rear surface for receipt of a round panel support member adequate to support the entire weight of the panel member, a second socket in the panel in substantial spaced relation to the first socket and open through the panel rear surface for receipt of an elongate torque resisting member, and a plurality of passages through the panel from the front to the rear surfaces thereof for receipt of tension members operable for holding the panel against the structure outer wall.

54. Apparatus according to claim 53 wherein the second socket is configured for receipt of a non-round torque resisting member.

55. Apparatus according to claim 53 including a round support pin receivable in the first socket and in a cooperating feature defined in the structure outer wall, a torque resisting member receivable in the second socket and in a cooperating feature defined in the structure outer wall, and a plurality of threaded tension members insertable through the passages and into threaded engagement with cooperating features defined in the structure outer wall.

56. Apparatus according to claim 53 including a third socket essentially identical to the first socket located in the panel vertically of the first socket and spaced a predetermined distance from the first socket.

57. Apparatus according to claim 53 wherein the first and second sockets are defined by passages through the panel, and means for closing the socket passages at the panel front wall.

58. Apparatus according to claim 53 wherein the panel member is fabricated principally of reinforced concrete.

59. A method for assembling and installing at a selected offshore site a surface-piercing, bottom-supported multi-tier offshore structure comprising the steps of a. providing each of the tiers of the structure as floatable constructions capable of being ballasted between positively and negatively buoyant states, b. at an assembly location in waters deeper than the sum of the light draft of a first and upper tier and the height of a second and lower tier, and shallower than the sum of said height and a deep draft floating state of the first tier construction, (1) ballasting the second tier construction to its negatively buoyant state to place it on the sea floor, (2) positioning the first tier in a floating state over the second tier construction in a selected orientation relative to the second tier construction, (3) ballasting the first tier construction toward its deep draft floating state thereby to move it into engagement with the second tier construction, (4) securing the engaged constructions from lateral relative movement, (5) and deballasting at least the second tier construction adequately to render the combination of the first and second tier constructions positively buoyant and free floating with the first tier loading the second tier, c. repeating in water of suitable depth the operations described in step b., as necessary, mutatis mutandis, with each additional tier construction proceeding downwardly through additional tier constructions and with each combination of engaged tier constructions above each additional tier construction, thereby to fully assemble all tier constructions of the offshore structure as a group, d. deballasting the group of fully assembled tier constructions to a draft less than the water depth at the selected site in such manner that each tier construction is loaded by the tier constructions thereabove, e. moving the group of assembled tier constructions to the selected site, f. ballasting the group of assembled tier constructions in such manner to maintain said loading and to sink into a condition of support by a sea floor at the site, and g. further ballasting the tier constructions to establish a desired effective mass of the group of tier constructions.

60. The method according to claim 59 wherein each tier construction is comprised of at least two modular structural units of essentially equal height and lengths as tier subunits, each tier subunit being floatable and controllably ballastable between positively and negatively buoyant states, and including the further step of connecting the subunits of each tier construction together at the assembly location to define the several tier constructions.

61. The method according to claim 60 wherein the positioning step described at step b.(2) in the claim 59, as practiced according to the appropriate one of steps b.(2) and c. of claim 59, includes orienting the tier subunits to be ballasted into engagement with a submerged tier construction with their lengths disposed transversely of the lengths of the subunits comprising the submerged tier construction.

62. The method according to claim 59 including the step of placing over substantially the entire area of the upper surface of each tier construction which is to be engaged at its upper surface by another tier construction a layer of a material which under load by said another tier construction conforms inelasticly to irregularities in the opposing surfaces of the tier constructions upon engagement.

63. The method according to claim 59 including the steps of establishing the location on the assembled group of tier constructions of the waterline thereof when the group is supported by the sea floor at the selected site, and attaching an ice resisting armor belt to the assembled group at the waterline substantially around the pertinent tier construction.

64. The method according to claim 59 including the further steps of engaging with floor at the selected site in a fully submerged state a base assembly having an upper surface sufficiently large to engage the bottom surface, over the area thereof, of the assembled group of tier constructions, the base assembly being arranged to receive and support the said desired effective mass and to distribute said mass over a larger area of the sea floor.

65. An arctic offshore structure of the gravity type movable buoyantly to and from a position over a site of use located on a sea floor under waters in a selected range of depths, the structure when installed at the site extending from a lower end substantially at the sea floor through and above the water surface to an upper operations end of the structure which is adapted to carry a selected operations facility, the structure through a portion thereof between (a) a first location adjacent its lower end and below the water surface and (b) a second location in the structure a substantial distance above the water surface being comprised of at least one base unit, each base unit being floatable, the structure being reversibly ballastable adequately to impart to the structure sufficient negative buoyancy, in combination with the nature of the sea floor, to maintain a desired position at the site under environmental forces applied horizontally to the structure, the structure in said portion being composed of at least a single tier of components of the structure, each tier being composed of a pair of base units of equal height, each base unit in each said tier having a sidewall arranged to face the sidewall of another base unit of the same tier in the structure, the facing sidewalls of the base units having registrable features operative upon registration for securing the base units from selected movements relative to each other.

66. Apparatus according to claim 65 including connection means releasably connected between the base units in each base unit tier operative for securing the connected base units from other movements relative to each other.

67. An arctic offshore structure of the gravity type movable buoyantly to and from a position over a site of use located on a sea floor under waters in a selected range of depths, the structure when installed at the site extending from a lower end substantially at the sea floor through and above the water surface to an upper operations end of the structure which is adapted to carry a selected operations facility, the structure through a portion thereof between (a) a first location adjacent its lower end and below the water surface and (b) a second location in the structure a substantial distance above the water surface being comprised of at least one base unit, each base unit being floatable, the structure being reversibly ballastable adequately to impart to the structure sufficient negative buoyancy, in combination with the nature of the sea floor, to maintain a desired position at the site under environmental forces applied horizontally to the structure, the structure including plural tiers of modular components of the structure including at least one base unit tier in a lower portion of the structure defined by at least one base unit and an upper tier, and vertical pin means cooperating between the tiers for securing the tiers from movement laterally relative to each other.

68. An arctic offshore structure of the gravity type movable buoyantly to and from a position over a site of use located on a sea floor under waters in a selected range of depths, the structure when installed at the site extending from a lower end substantially at the sea floor through and above the water surface to an upper operations end of the structure which is adapted to carry a selected operations facility, the structure through a portion thereof between (a) a first location adjacent its lower end and below the water surface and (b) a second location in the structure a substantial distance above the water surface being comprised of at least one base unit, each base unit being floatable, the structure being reversibly ballastable adequately to impart to the structure sufficient negative buoyancy, in combination with the nature of the sea floor, to maintain a desired position at the site under environmental forces applied horizontally to the structure, the structure being composed of plural tiers of modular components of the structure including at least one base unit tier in a lower portion of the structure defined by at least one base unit and an upper tier, and a locally deformable layer of inelastic material disposed between tiers.

69. An arctic offshore structure of the gravity type movable buoyantly to and from a position over a site of use located on a sea floor under waters in a selected range of depths, the structure when installed at the site extending from a lower end substantially at the sea floor through and above the water surface to an upper operations end of the structure which is adapted to carry a selected operations facility, the structure through a portion thereof between (a) a first location adjacent its lower end and below the water surface and (b) a second location in the structure a substantial distance above the water surface being comprised of at least one unitary base unit, each base unit being floatable and being reversibly ballastable adequately to impart to the structure sufficient negative buoyancy, in combination with the nature of the sea floor, to maintain a desired position at the site under environmental forces applied horizontally to the structure, an environmental armor belt of selected height carried by the structure about its circumference in said portion of the structure, the armor belt extending vertically on the structure from above the water surface to below the water surface, the armor belt being comprised of a plurality of discrete armor panels each of the selected height, panel connection means releasably connectible between each panel and the adjacent base unit for securely connecting the panel to the base unit, the connection means including, for each panel, first connection means for carrying shear loads between the panel and the adjacent base unit, second connection means operative for carrying torque loads between the panel and the base unit, and third connection means for carying loads urging the panel away from the base unit.

70. Apparatus according to claim 69 wherein each connection means includes a resilient member disposed between the panel and the base unit.

71. An arctic offshore structure of the gravity type comprising a base engageable with a sea floor at a location under water of depth within a selected range of depths, a deck structure, and a central structure supportable on the base for supporting the deck structure above the water surface, the base and central structure being floatable and ballastable to a state of substantial negative buoyancy, the base having a bottom surface of selected area, the central structure having side surfaces and a bottom surface of area less than the base bottom surface area, the deck structure being constructed predominantly of steel and the central structure having a substantial portion thereof, including the portions thereof defining the side surfaces, constructed of reinforced concrete, the central structure side surfaces being substantially flat.

72. Apparatus according to claim 71 wherein the central structure, in horizontal reference planes through the central structure, has an exterior outline of a rectangle with chamfered corners.

73. The combination of a fabricated offshore structure adapted to be supported on a sea floor to extend through the water surface, and an armor belt affixed to exterior surfaces of the offshore structure at the water surface and extending vertically therealong for selected distances above and below the water surface, the belt being comprised of a plurality of constructed panel members, and characterized in that each panel member has selected height and width for covering a substantial area of the exterior of the offshore structure, each panel having a thickness between front and rear surfaces thereof adequate in combination with the construction of the panel member for distributing over said area loads applied laterally to the panel front surface as by an ice floe contacting the panel member, and means mounting each panel to the offshore structure including first mounting means defined cooperatively in the panel and the offshore structure for supporting the vertical load of the panel on the structure, and second different mounting means defined cooperatively in the panel and the offshore structure separate from the first mounting means for holding the panel to the offshore structure.

74. The combination according to claim 73 wherein the first mounting means are defined in the panel centrally of its width.

75. The combination according to claim 73 wherein, for each panel, the offshore structure defines in a vertical arrangement of more of said first and second mounting means than are defined in the panel, whereby the panel is affixable to the offshore structure at any one of plural discrete locations spaced vertically on the offshore structure.

76. The combination according to claim 73 wherein the exterior surfaces of the offshore structure to which the belt is affixed are substantially flat surfaces, and wherein the mounting means includes third mounting means, different from the first and second mounting means, cooperatively defined in at least some of the panels and in the offshore structure in spaced relation to the first mounting means operable following engagement of the first mounting means and before engagement of the second mounting means for securing the panel from angular motion relative to the offshore structure about the first mounting means.

77. The combination according to claim 73 wherein the panel is constructed of reinforced concrete.

* * * * *

UNITED STATES PATENT AND TRADEMARK OFFICE

CERTIFICATE OF CORRECTION

PATENT NO. : 4,511,288

DATED : April 16, 1985

INVENTOR(S) : Sherman B. Wetmore

It is certified that error appears in the above-identified patent and that said Letters Patent is hereby corrected as shown below:

Col. 15, line 22, for "84" read -- 85 --.

Col. 20, line 22, for "ar" read -- are --;
Col. 20, line 43, before "The" insert a period.

Col. 21, line 44, for "day" read -- dry --.

Col. 22, line 54, for "receive" read -- receiver.

Col. 23, line 23, for "125" read -- 127 --.

Col. 24, line 44, for "coverage" read -- converge --.

Col. 30, line 9, for "frowm" read -- from --;
Col. 30, line 16, for "claim 6" read -- claim 5 --.

Col. 33, line 35, for "and" read -- the --.

Col. 36, line 2, after "in" delete -- the --;
Col. 36, line 25, after "with" read -- the sea.

Signed and Sealed this

*Fifteenth* Day of *October 1985*

[SEAL]

*Attest:*

DONALD J. QUIGG

*Attesting Officer*

*Commissioner of Patents and Trademarks—Designate*